US005323486A

United States Patent [19]

Taniguchi et al.

[11] Patent Number: 5,323,486

[45] Date of Patent: Jun. 21, 1994

[54] SPEECH CODING SYSTEM HAVING CODEBOOK STORING DIFFERENTIAL VECTORS BETWEEN EACH TWO ADJOINING CODE VECTORS

[75] Inventors: Tomohiko Taniguchi, Kawasaki, Japan; Mark Johnson, Cambridge, Mass.; Yasuji Ohta, Kawasaki, Japan; Hideaki Kurihara, Kawasaki, Japan; Yoshinori Tanaka, Kawasaki, Japan; Yoshihiro Sakai, Kawasaki, Japan

[73] Assignee: Fujitsu Limited, Kawasaki, Japan

[21] Appl. No.: 856,221

[22] PCT Filed: Sep. 17, 1991

[86] PCT No.: PCT/JP91/01235

§ 371 Date: May 14, 1992

§ 102(e) Date: May 14, 1992

[87] PCT Pub. No.: WO92/05541

PCT Pub. Date: Apr. 2, 1992

[30] Foreign Application Priority Data

Sep. 14, 1990 [JP] Japan ..... 2-244174
May 30, 1991 [JP] Japan ..... 3-127669

[51] Int. Cl.[5] ..... G10L 9/00

[52] U.S. Cl. ..... 395/2.31; 395/2.29

[58] Field of Search ..... 381/29-41; 395/2.31, 2.29

[56] References Cited

U.S. PATENT DOCUMENTS 4,868,867 9/1989 Davidson et al. ..... 381/35
4,991,214 2/1991 Freeman et al. ..... 381/38
5,144,671 9/1992 Mazor et al. ..... 381/36
5,151,968 9/1992 Tanaka et al. ..... 381/31

FOREIGN PATENT DOCUMENTS 61-237519 10/1986 Japan .
63-240600 10/1988 Japan .
1-296300 11/1989 Japan .

OTHER PUBLICATIONS

Ozawa et al. "4kb/s Improved Celp Coder with Efficient Vector Quantization" IEEE, 1991, pp. 213-216.

*Primary Examiner*—Michael R. Fleming
*Assistant Examiner*—Michelle Doerrler
*Attorney, Agent, or Firm*—Staas & Halsey

[57] ABSTRACT

A speech coding system is provided where input speech is coded by finding via an evaluation computation a code vector giving a minimum error between reproduced signals obtained by linear prediction analysis filter processing, simulating speech path characteristics, on code vectors successively read out from a noise codebook storing a plurality of noise trains as code vectors and an input speech signal and by using a code specifying the code vector. In the speech coding system, the noise codebook includes a delta vector codebook which stores an initial vector and a plurality of delta vectors having difference vectors between adjoining code vectors. In addition, provision is made in the computing unit for the evaluation computation of a cyclic adding unit for cumulatively adding the delta vectors to virtually reproduce the code vectors.

32 Claims, 27 Drawing Sheets

SAMPLE POINTS

MODE A : $C_0=e_x, \Delta C_1=e_y, \Delta C_2=e_z$

MODE B : $C_0=e_y, \Delta C_1=e_x, \Delta C_2=e_z$

MODE C : $C_0=e_z, \Delta C_1=e_x, \Delta C_2=e_y$ $C_0=e_x, \Delta C_1=e_y, \Delta C_2=e_z$ $|A(e_z)|^2>|A(e_x)|^2>|A(e_y)|^2$ $C_0=e_z, \Delta C_1=e_x, \Delta C_2=e_y$

Fig. 25

| | | CODE BOOK | FILTER | CROSS CORRE-LATION | AUTO-CORRE-LATION | TOTAL ($N_p$=10) | TOTAL N=10 |
|---|---|---|---|---|---|---|---|
| SEQUEN-TIAL OPTIMI-ZATION SYSTEM (a) | 1 | 4/5 SPARSE | $N^2/10$ | N/5 | N | $N^2/10$ +1.2N | 432K |
| | 2 | OVERLAP (ONE NEW SAMPLE/ VECTOR + 4/5 SPARSE) | N/5 | N/5 | N | 1.4N | 84K |
| | 3 | 2SAMPLE DELTA VECTOR (4/5 SPARSE) | 0 | 2 | 2N/5 +2 | 0.4N +4 | 28K |
| SIMUL-TANEOUS OPTIMI-ZATION SYSTEM (b) | 1 | 4/5 SPARSE | $N^2/10$ | 2N/5 | N | $N^2/10$ +1.4N | 444K |
| | 2 | OVERLAP (ONE NEW SAMPLE/ VECTOR + 4/5 SPARSE) | N/5 | 2N/5 | N | 1.6N | 96K |
| | 3 | 2 SAMPLES DELTA VECTOR (4/5 SPARSE) | 0 | 4 | 2N/5 +2 | 0.4N +6 | 30K |
| PITCH ORTHOGO-NAL TRANS-FORMA-TION OPTIMIZA-TION SYSTEM (c) | 1 | 4/5 SPARSE | $N^2/5$ +1.2N | N/5 | N | $N^2/10$ +2.4N | 504K |
| | 2 | OVERLAP (ONE NEW SAMPLE/ VECTOR + 4/5 SPARSE) | 1.4N | N/5 | N | 2.6N | 156K |
| | 3 | 2 SAMPLES DELTA VECTOR (4/5 SPARSE) | 0 | 2 | 2N/5 +2 | 0.4N +4 | 28K |

Fig. 26

| | | | CONVENTIONAL SYSTEM | | SYSTEM ACCORDING TO SECOND EMBODIMENT OF PRESENT INVENTION | |
|---|---|---|---|---|---|---|
| (a) | COMPUTATION | FILTER | Np×N×M | 400K MAC (N=40,M=1024) | Np×N×L | 4 K MAC (N=40, L=10) |
| | | CROSS CORRELATION | N×M | 40K MAC (N=40,M=1024) | N×L | 0.4 K MAC (N=40,L=10) |
| | | AUTO-CORRELATION | N×M | 40K MAC (N=40,M=1024) | $\frac{N \times L(L+1)}{2}$ | 2.2 K MAC (N=40,L=10) |
| | | TOTAL | | 480 K MAC (96 Mops) | | 6.6 K MAC (1.3 Mops) |
| (b) | MEMORY CAPACITY SIZE | | N×M | 40K WORDS | N×L | 0.4K WORDS |

* MAC : MULTIPLICATION and ACCUMULATION OPERATIONS

SPEECH CODING SYSTEM HAVING CODEBOOK STORING DIFFERENTIAL VECTORS BETWEEN EACH TWO ADJOINING CODE VECTORS

BACKGROUND OF THE INVENTION

1. Field of the Invention

The present invention relates to a speech coding system for compression of data of speech signals, and more particularly relates to a speech coding system using analysis-by-synthesis (A-b-S) type vector quantization for coding at a transmission speed of 4 to 16 kbps, that is, using vector quantization performing analysis by synthesis.

2. Background of the Related Art

Speech coders using A-b-S type vector quantization, for example, code-excited linear prediction (CELP) coders, have in recent years been considered promising as speech coders for compression of speech signals while maintaining quality in intracompany systems, digital mobile radio communication, etc. In such a quantized speech coder (hereinafter simply referred to as a "coder"), predictive weighting is applied to the code vectors of a codebook to produce reproduced signals, the error powers between the reproduced signals and the input speech signal are evaluated, and the number (index) of the code vector giving the smallest error is decided on or determined and sent to the receiver side.

A coder using the above-mentioned A-b-S type vector quantization system performs processing so as to apply linear prediction analysis filter processing to each of the vectors of the sound generator signals, of which there are about 1000 patterns stored in the codebook, and retrieve from among the approximately 1000 patterns the one pattern giving the smallest error between the reproduced speech signals and the input speech signal to be coded.

Due to the need for instantaneousness in conversation, the above-mentioned retrieval processing must be performed in real time. This being so, the retrieval processing must be performed continuously during the conversation at short time intervals of 5 ms, for example.

As mentioned later, however, the retrieval processing includes complicated computation operations of filter computation and correlation computation. The amount of computation required for these computation operations is huge, being, for example, several 100M multiplications and additions per second. To deal with this computational complexity, even with digital signal processors (DSP), which are the highest in speed at present, several DSP chips are required. In the case of use for cellular telephones, for example, there is the problem of achieving a small size and a low power consumption.

SUMMARY OF THE INVENTION

The present invention, in consideration of the above-mentioned problems, has as its object the provision of a speech coding system which can tremendously reduce the amount of computation while maintaining the properties of an A-b-S type vector quantization coder of high quality and high efficiency.

The present invention, to achieve the above object, adds differential vectors (hereinafter referred to as delta vectors) $\Delta C_n$ to the previous code vectors $C_{n-1}$ among the code vectors of the codebook and stores in the codebook the group of code vectors producing the next code vectors $C_n$. Here, n indicates the order in the group of code vectors.

BRIEF DESCRIPTION OF THE DRAWINGS

The present invention will be explained below while referring to the appended drawings, in which:

FIG. 25 is a view showing the ability to reduce the amount of computation by the first embodiment of the present invention, and FIG. 26 is a view showing the ability to reduce the amount of computation and to slash the memory size by the second embodiment of the present invention.

DESCRIPTION OF THE PREFERRED EMBODIMENT

Figure 1:
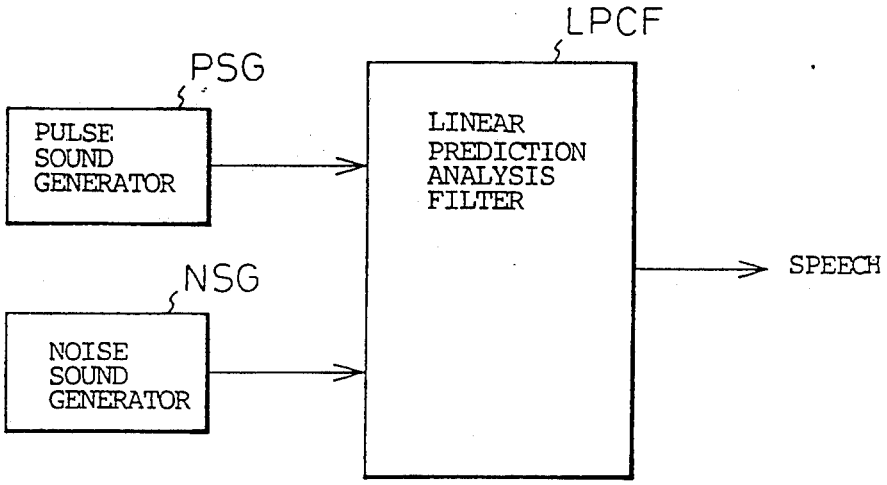
FIG. 1 is a view for explaining the mechanism of speech generation.

FIG. 1 is a view for explaining the mechanism of speech generation.

Speech includes voiced sounds and unvoiced sounds. Voiced sounds are produced based on the generation of pulse sounds through vibration of the vocal cords and are modified by the speech path characteristics of the throat and mouth of the individual to form part of the speech. Further, the unvoiced sounds are sounds produced without vibration of the vocal cords and pass through the speech path to become part of the speech using a simple Gaussian noise train as the source of the sound. Therefore, the mechanism for generation of speech, as shown in FIG. 1, can be modeled as a pulse sound generator PSG serving as the origin for voiced sounds, a noise sound generator NSG serving as the origin for unvoiced sounds, and a linear prediction analysis filter LPCF for adding speech path characteristics to the signals output from the sound generators (PSG and NSG). Note that the human voice has periodicity and the period corresponds to the periodicity of the pulses output from the pulse sound generator PSG. The periodicity differs according to the person and the content of the speech.

Due to the above, if it were possible to specify the pulse period of the pulse sound generator corresponding to the input speech and the noise train of the noise sound generator, then it would be possible to code the input speech by a code (data) identifying the pulse period and noise train of the noise sound generator.

Therefore, an adaptive codebook is used to identify the pulse period of the pulse sound generator based on the periodicity of the input speech signal, the pulse train having the period is input to the linear prediction analysis filter, filter computation processing is performed, the resultant filter computation results are subtracted from the input speech signal, and the period component is removed. Next, a predetermined number of noise trains (each noise train being expressed by a predetermined code vector of N dimensions) are prepared. If the single code vector giving the smallest error between the reproduced signal vectors composed of the code vectors subjected to analysis filter processing and the input signal vector (N dimension vector) from which the period component has been removed can be found, then it is possible to code the speech by a code (data) specifying the period and the code vector. The data is sent to the receiver side where the original speech (input speech signal) is reproduced. This data is highly compressed information.

Figure 2:
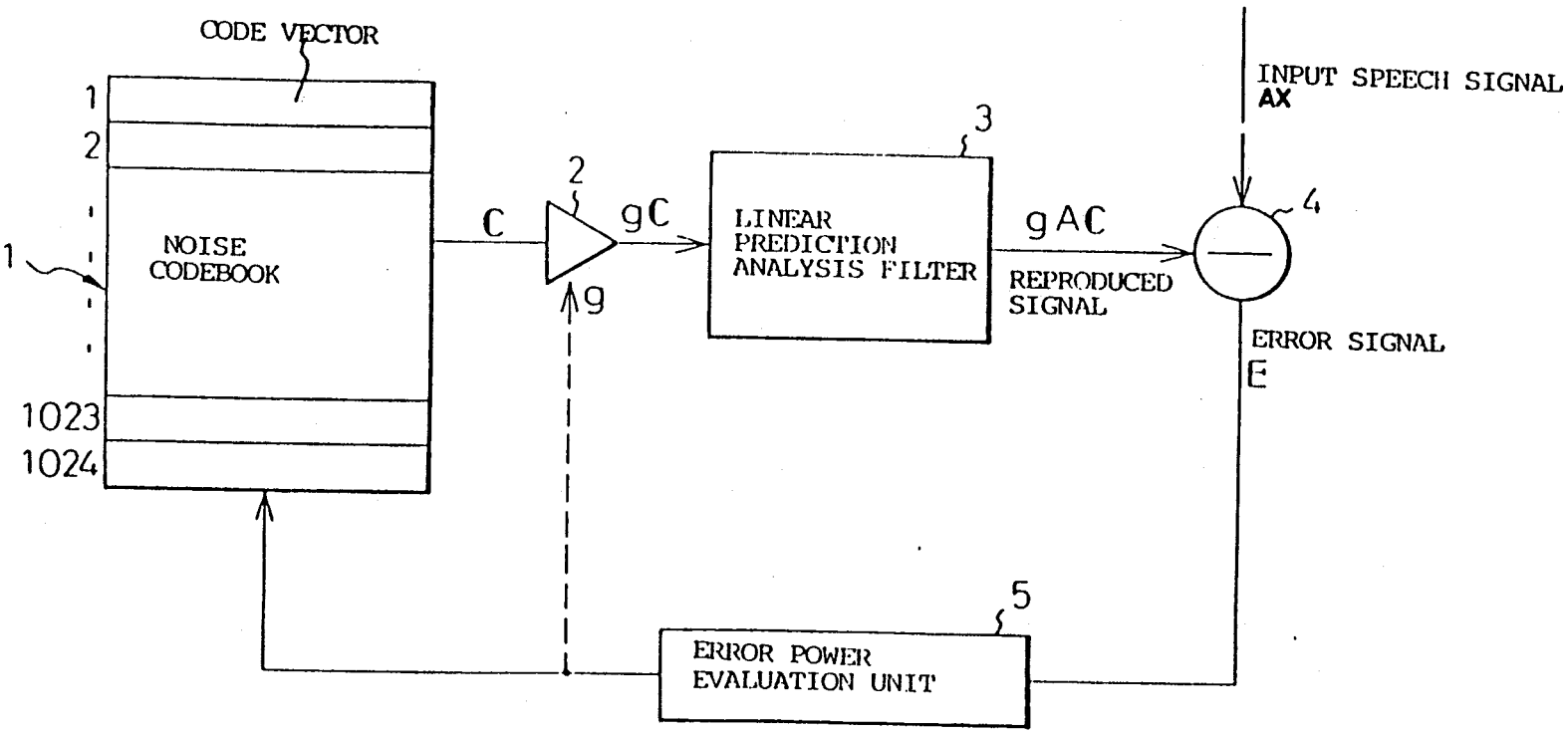
FIG. 2 is a block diagram showing the general construction of an A-b-S type vector quantization speech coder.

FIG. 2 is a block diagram showing the general construction of an A-b-S type vector quantization speech coder. In the figure, reference numeral 1 indicates a noise codebook which stores a number, for example, 1024 types, of noise trains C (each noise train being expressed by an N dimension code vector) generated at random, 2 indicates an amplifying unit with a gain g, 3 indicates a linear prediction analysis filter which performs analysis filter computation processing simulating speech path characteristics on the output of the amplifying unit, 4 indicates an error generator which outputs errors between reproduced signal vectors output from the linear prediction analysis filter 3 and the input signal vector, and 5 indicates an error power evaluation unit which evaluates the errors and finds the noise train (code vector) giving the smallest error.

In vector quantization by the A-b-S system, unlike with ordinary vector quantization, the optimal gain g is multiplied with the code vectors (C) of the noise codebook 1, then filter processing is performed by the linear prediction analysis filter 3, the error signals (E) between the reproduced signal vectors (gAC) obtained by the filter processing and the input speech signal vector (AX) are found by the error generator 4, retrieval is performed on the noise codebook 1 using the power of the error signals as the evaluation function (distance scale) by the error power evaluation unit 5, the noise train (code vector) giving the smallest error power is found, and the input speech signal is coded by a code specifying the noise train (code vector). A is a perceptual weighting matrix.

The above-mentioned error power is given by the following equation:

$$\|E\|^2 = AX - gAC^2 \quad (1)$$

The optimal code vector C and the gain g are determined by making the error power shown in equation (1) the smallest possible. Note that the power differs depending on the loudness of the voice, so the gain g is optimized and the power of the reproduced signal gAC is matched with the power of the input speech signal AX. The optimal gain may be found by partially differentiating equation (1) by g and making it 0. That is, $$d\|E\|^2/dg = 0$$

whereby g is given by $$g = ((AX)^T(AC))/((AC)^T(AC)) \quad (2)$$

If this g is substituted in equation (1), then the result is $$\|E\|^2 = \|AX\|^2 - ((AX)^T(AC)^2)/((AC)^T(AC)) \quad (3)$$

If the cross correlation between the input signal AX and the analysis filter output AC is $R_{XC}$ and the auto correlation of the analysis filter output AC is $R_{CC}$, then the cross correlation and auto correlation are expressed by the following equations:

$$R_{XC} = (AX)^T(AC) \quad (4)$$

$$R_{CC} = (AC)^T(AC) \quad (5)$$

Note that T indicates a transposed matrix.

The code vector C giving the smallest error power E of equation (3) gives the largest second term on the right side of the same equation, so the code vector C may be expressed by the following equation:

$$C = argmax(R_{XC}^2/R_{CC}) \quad (6)$$

(where argmax is the maximum argument). The optimal gain is given by the following using the cross correlation and auto correlation satisfying equation (6) and from the equation (2):

$$g = R_{XC}/R_{CC} \tag{7}$$

Figure 3:
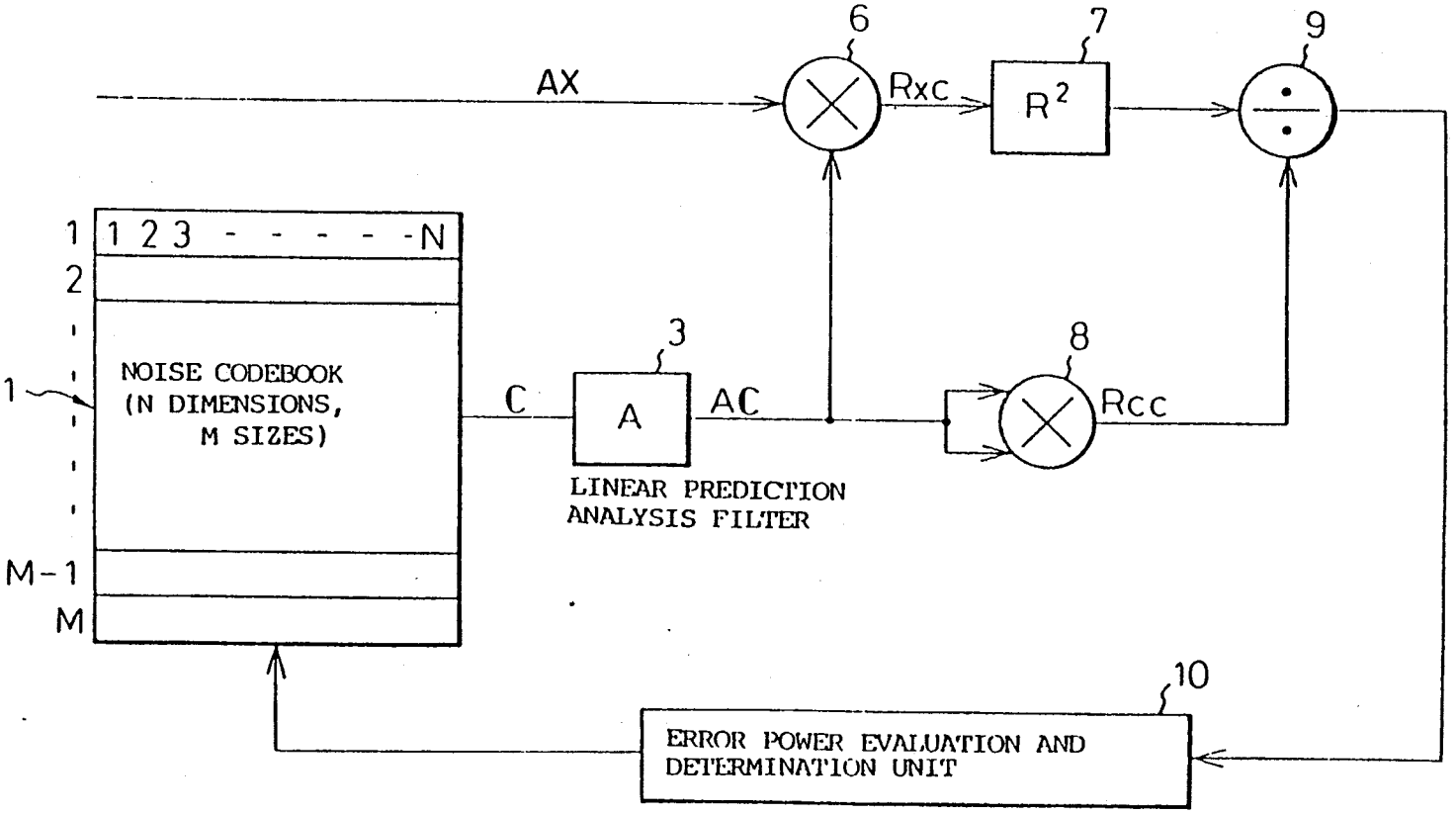
FIG. 3 is a block diagram showing in more detail the portion of the codebook retrieval processing in the construction of FIG. 2.

FIG. 3 is a block diagram showing in more detail the portion of the codebook retrieval processing in the construction of FIG. 2. That is, it is a view of the portion of the noise codebook retrieval processing for coding the input signal by finding the noise train (code vector) giving the smallest error power. Reference numeral 1 indicates a noise codebook which stores M types (size M) of noise trains C (each noise train being expressed by an N dimensional code vector), and 3 a linear prediction analysis filter (LPC filter) of $N_P$ analysis orders which applies filter computation processing simulating speech path characteristics. Note that an explanation of the amplifying unit 2 of FIG. 2 is omitted.

Reference numeral 6 is a multiplying unit which computes the cross correlation $R_{XC}(=(AX)^T(AC)$, 7 is a square computation unit which computes the square of the cross correlation $R_{XC}$, 8 is an auto correlation computation unit which computes the auto correlation $R_{CC}(=(AC)^T(AC))$, 9 is a division unit which computes $R_{XC}^2/R_{CC}$, and 10 is an error power evaluation and determination unit which determines the noise train (code vector) giving the largest $R_{XC}^2/R_{CC}$, in other words, the smallest error power, and thereby specifies the code vector. These constituent elements 6, 7, 8, 9, and 10 correspond to the error power evaluation unit 5 of FIG. 2.

In the above-mentioned conventional codebook retrieval processing, the problems mentioned previously occurred. These will be explained further here.

There are three main parts of the conventional codebook retrieval processing: (1) filter processing on the code vector C, (2) calculation processing for the cross correlation $R_{XC}$, and (3) calculation processing of the auto correlation $R_{CC}$. Here, if the number of orders of the LPC filter 3 is $N_P$ and the number of dimensions of the vector quantization (code vector) is N, the amount of computation required for the above (1) to (3) for a single code vector become $N_P$·N, N, and N. Therefore, the amount of computation required for codebook retrieval per code vector becomes $(N_P+2)$·N. The noise codebook 1 usually used has 40 dimensions and a codebook size of 1024 (N=40, M=1024) or so, while the number of analysis orders of the LPC filter 3 is about 10, so a single codebook retrieval requires $$(10+2)\cdot 40\cdot 1024 = 480K$$

multiplication and accumulation operations. Here, $K=10^3$.

This codebook retrieval is performed with each subframe (5 msec) of the speech coding, so a massive processing capability of 96 $M_{ops}$ (megaoperations per second) becomes necessary. Even with the currently highest speed digital signal processor (allowable computations of 20 to 40 Mops), it would require several chips to perform real time processing. This is a problem. Below, several embodiments for eliminating this problem will be explained.

Figure 4:
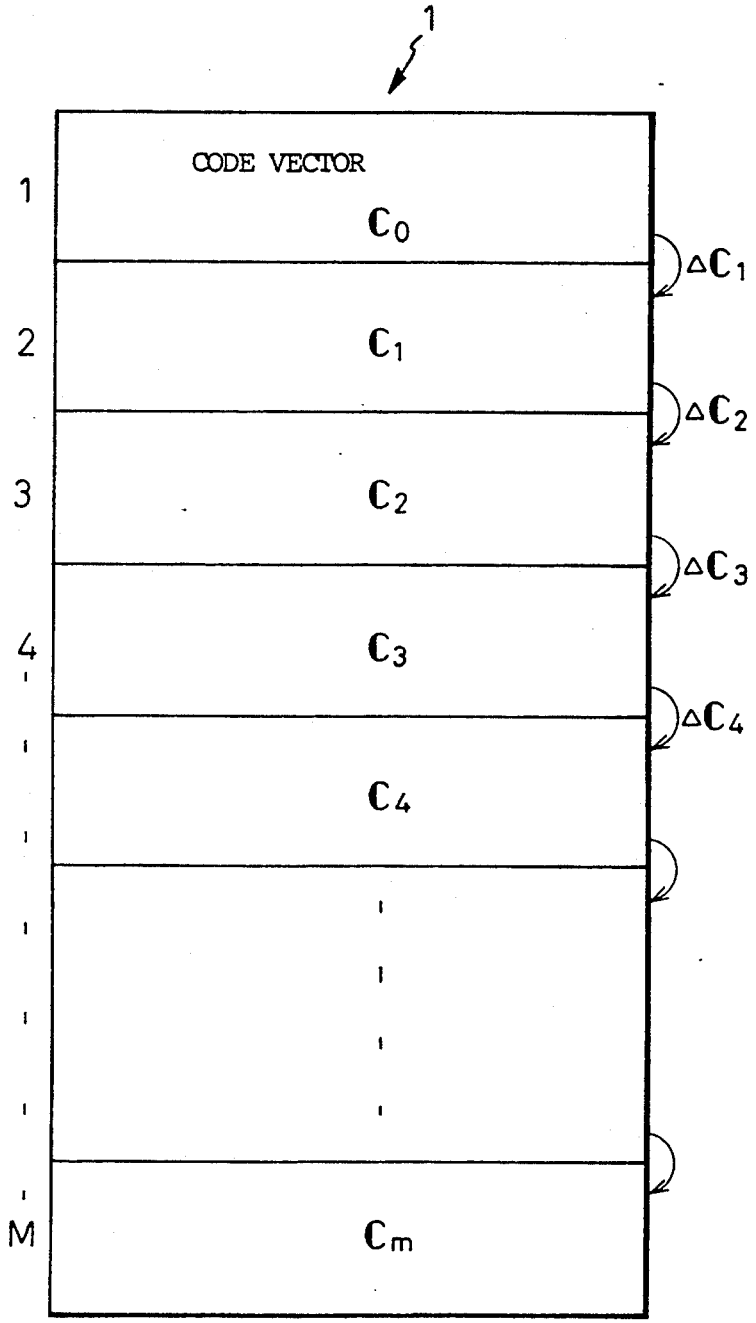
FIG. 4 is a view showing the basic concept of the present invention.

FIG. 4 is a view showing the basic concept of the present invention. The noise codebook 1 of the figure stores M number of noise trains, each of N dimensions, as the code vectors $C_0, C_1, C_2 \ldots C_3, C_4 \ldots C_m$. Usually, there is no relationship among these code vectors. Therefore, in the past, to perform the retrieval processing of FIG. 3, the computation for evaluation of the error power was performed completely independently for each and every one of the m number of code vectors.

However, if the way the code vectors are viewed is changed, then it is possible to give a relation among them by the delta vectors ΔC as shown in FIG. 4. Expressed by a numerical equation, this becomes as follows when m is equal to 1024:

$$\begin{aligned} C_0 &= C_0 \\ C_1 &= C_0 + \Delta C_1 \\ C_2 &= C_1 + \Delta C_2 \; (=C_0 + \Delta C_1 + \Delta C_2) \\ C_3 &= C_2 + \Delta C_3 \; (=C_0 + \Delta C_1 + \Delta C_2 + \Delta C_3) \\ &\vdots \\ C_{1023} &= C_{1022} + \Delta C_{1023} \; (=C_0 + \Delta C_1 + \ldots + \Delta C_{1023}) \end{aligned} \tag{8}$$

Looking at the code vector $C_2$, for example, in the above-mentioned equations, it includes as an element the code vector $C_1$. This being so, when computation is performed on the code vector $C_2$, the portion relating to the code vector $C_1$ has already been completed and if use is made of the results, it is sufficient to only change or compute the delta vector $\Delta C_2$ for the remaining computation.

This being so, it is necessary that the delta vectors ΔC be made as simple as possible. If the delta vectors ΔC are complicated, then in the case of the above example, there would not be that much of a difference between the amount of computation required for independent computation of the code vector $C_2$ as in the past and the amount of computation for changing the delta vector $\Delta C_2$.

Figure 5:
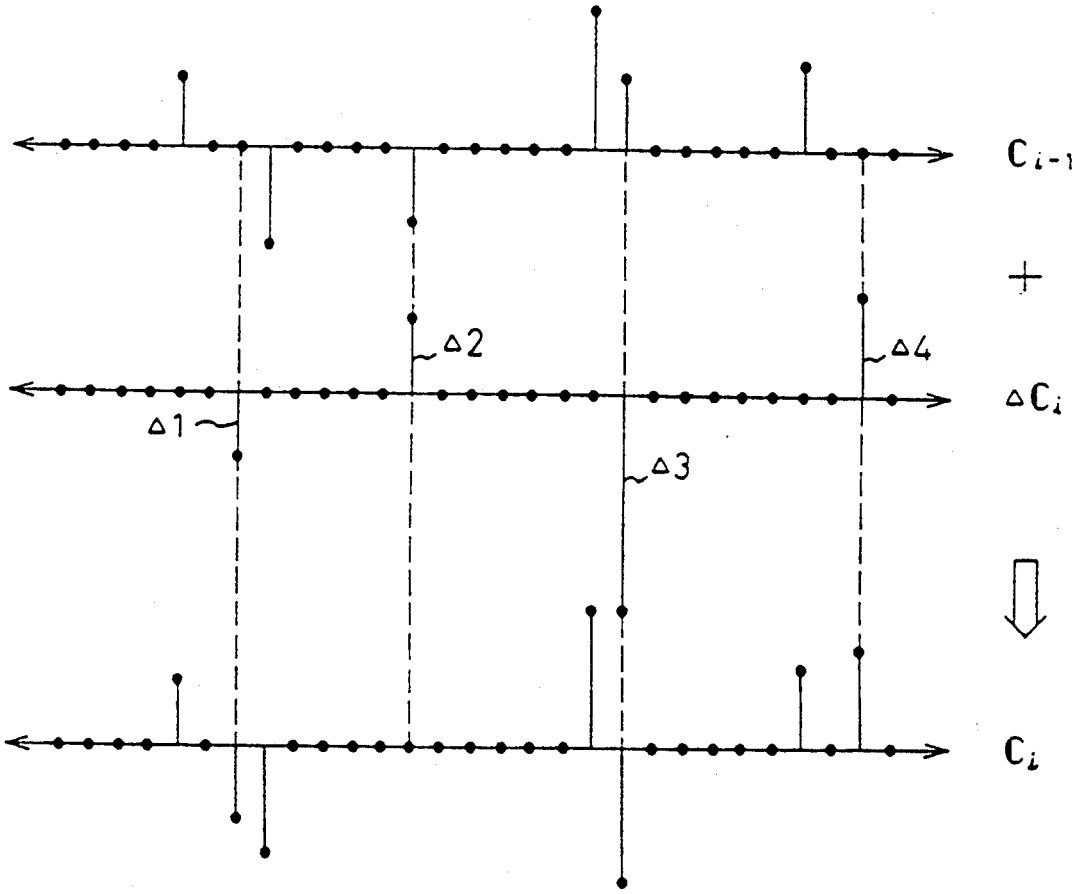
FIG. 5 is a view showing simply the concept of the first embodiment based on the present invention.

FIG. 5 is a view showing simply the concept of the first embodiment based on the present invention. Any next code vector, for example, the i-th code vector $C_i$, becomes the sum of the previous code vector, that is, the code vector $C_{i-1}$, and the delta vector $\Delta C_i$. At this time, the delta vector $\Delta C_i$ has to be as simple as possible as mentioned above. The rows of black dots drawn along the horizontal axes of the sections $C_{i-1}$, $\Delta C_i$, and $C_i$ in FIG. 5 are N in number (N samples) in the case of an N dimensional code vector and correspond to sample points on the waveform of a noise train. When each code vector is comprised of, for example, 40 samples (N=40), there are 40 black dots in each section. In FIG. 5, the example is shown where the delta vector $\Delta C_i$ is comprised of just four significant sampled data Δ1, Δ2, Δ3, and Δ4, which is extremely simple.

Explained from another angle, when a noise codebook 1 stores, for example, 1024 (M=1024) patterns of code vectors in a table, one is completely free to arrange these code vectors however one wishes, so one may rearrange the code vectors of the noise codebook 1 so that the differential vectors (ΔC) become as simple as possible when the differences between adjoining code vectors ($C_{i-1}$, $C_i$) are taken. That is, the code vectors are arranged to form an original table so that no matter what two adjoining code vectors ($C_{i-1}$, $C_i$) are taken, the delta vector ($\Delta C_i$) between the two becomes a simple vector of several pieces of sample data as shown in FIG. 5.

If this is done, then by storing the results of the computations performed on the initial vector $C_0$ as shown by the above equation (8), subsequently it is sufficient to perform computation for changing only the portions of the simple delta vectors $\Delta C_1$, $\Delta C_2$, $\Delta C_3$ . . . for the code vectors $C_1$, $C_2$, $C_3$ . . . and to perform cyclic addition of the results of $C_1$.

Note that as the code vectors $C_{i-1}$ and $C_i$ of FIG. 5, the example was shown of the use of the sparsed code vectors, that is, code vectors previously processed so as to include a large number of codes of a sample value of zero. The sparsing technique of code vectors is known.

Specifically, delta vector groups are successively stored in a delta vector codebook 11 (mentioned later) so that the difference between any two adjoining code vectors $C_{i-1}$ and $C_i$ becomes the simple delta vector $\Delta C_i$.

Figure 6:
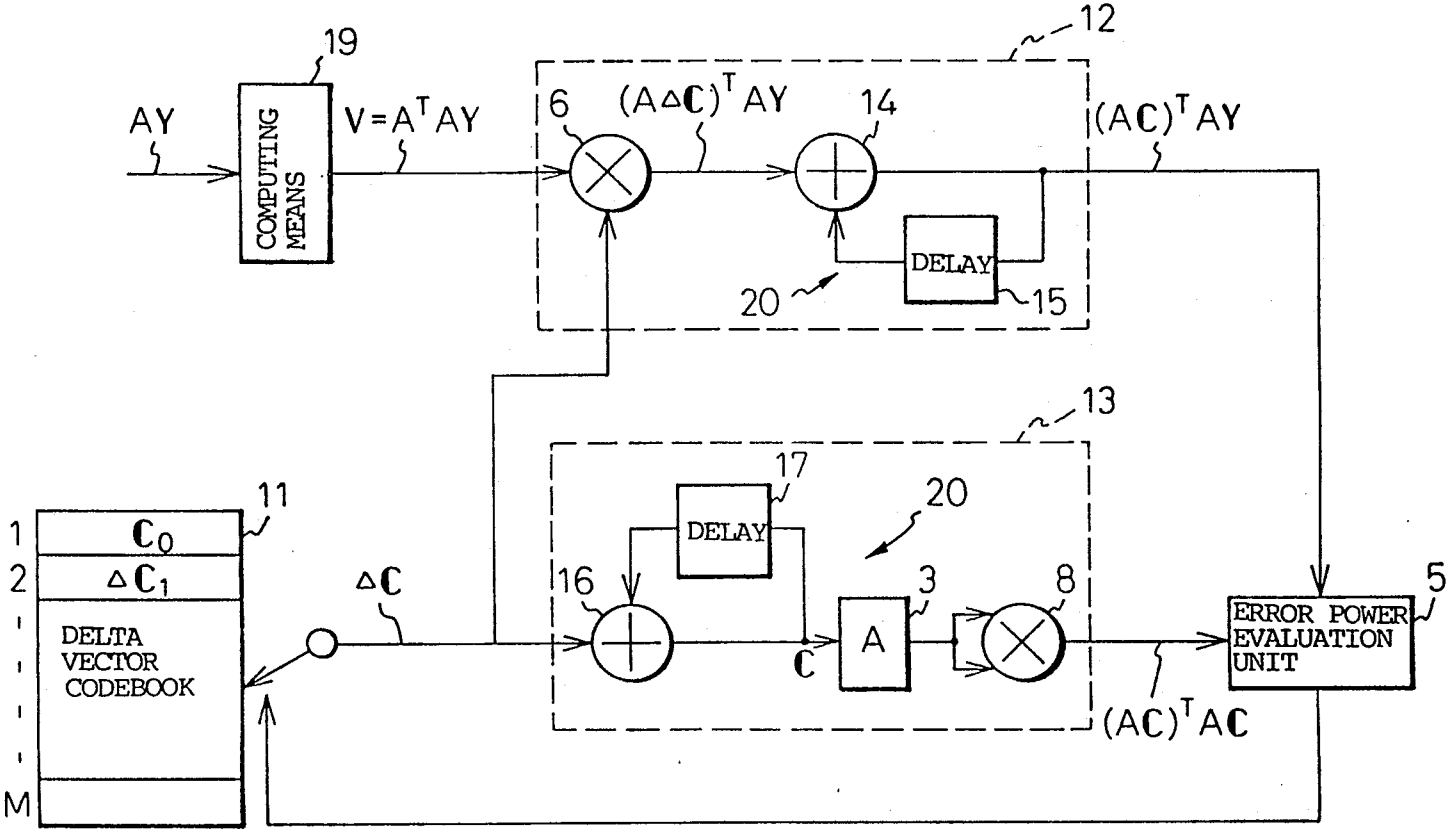
FIG. 6 is a block diagram showing in more detail the portion of the codebook retrieval processing based on the first embodiment.

FIG. 6 is a block diagram showing in more detail the portion of the codebook retrieval processing based on the first embodiment. Basically, this corresponds to the construction in the previously mentioned FIG. 3, but FIG. 6 shows an example of the application to a speech coder of the known sequential optimization CELP type. Therefore, instead of the input speech signal AX (FIG. 3), the perceptually weighted pitch prediction error signal vector AY is shown, but this has no effect on the explanation of the invention. Further, the computing unit 19 is shown, but this is a previous processing stage accompanying the shift of the linear prediction analysis filter 3 from the position shown in FIG. 3 to the position shown in FIG. 6 and is not an important element in understanding the present invention.

The element corresponding to the portion for generating the cross correlation $R_{XC}$ in FIG. 3 is the cross correlation computation unit 12 of FIG. 6. The element corresponding to the portion for generating the auto correlation $R_{CC}$ of FIG. 3 is the auto correlation computation unit 13 of FIG. 6. In the cross correlation computation unit 12, the cyclic adding unit 20 for realizing the present invention is shown as the adding unit 14 and the delay unit 15. Similarly, in the auto correlation computation unit 13, the cyclic adding means 20 for realizing the present invention is shown as the adding unit 16 and the delay unit 17.

The point which should be noted the most is the delta vector codebook 11 of FIG. 6. The code vectors $C_0$, $C_1$, $C_2$ . . . are not stored as in the noise codebook 1 of FIG. 3. Rather, after the initial vector $C_0$, the delta vectors $\Delta C_1$, $\Delta C_2$, $\Delta C_3$ . . . , the differences from the immediately preceding vectors, are stored.

When the initial vector $C_0$ is first computed, the results of the computation are held in the delay unit 15 (same for delay unit 17) and are fed back to be cyclically added by the adding unit 14 (same for adding unit 16) to the next arriving delta vector $\Delta C_1$. After this, in the same way, in the end, processing is performed equivalent to the conventional method, which performed computations separately on the following code vectors $C_1$, $C_2$, $C_3$ . . . .

This will be explained in more detail below. The perceptually weighted pitch prediction error signal vector AY is transformed to $A^TAY$ by the computing means 21, the delta vectors $\Delta C$ of the delta vector codebook 11 are given to the cross correlation computation unit 12 as they are for multiplication, and the previous correlation value $(AC_{i-1})^TAY$ is cyclically added, so as to produce the correlation $(AC)^TAY$ of the two.

That is, since $C_{i-1}\Delta C_i = C_i$, using the computation $$\begin{aligned}(AC_i)^TAY &= (C_{i-1} + \Delta C_i)^TA^TAY \\ &= (\Delta C_i)^TA^TAY + (AC_{i-1})^TAY\end{aligned} \quad (9)$$

the present correlation value $(AC)^TAY$ is produced and given to the error power evaluation unit 5.

Further, as shown in FIG. 6, in the auto correlation computation unit 13, the delta vectors $\Delta C$ are cyclically added with the previous code vectors $C_{i-1}$, so as to produce the code vectors $C_i$, and the auto correlation values $(AC)^TAC$ of the code vectors AC after perceptually weighted reproduction are found and given to the evaluation unit 5.

Therefore, in the cross correlation computation unit 12 and the auto correlation computation unit 13, it is sufficient to perform multiplication with the sparsed delta vectors, so the amount of computation can be slashed.

Figure 7:
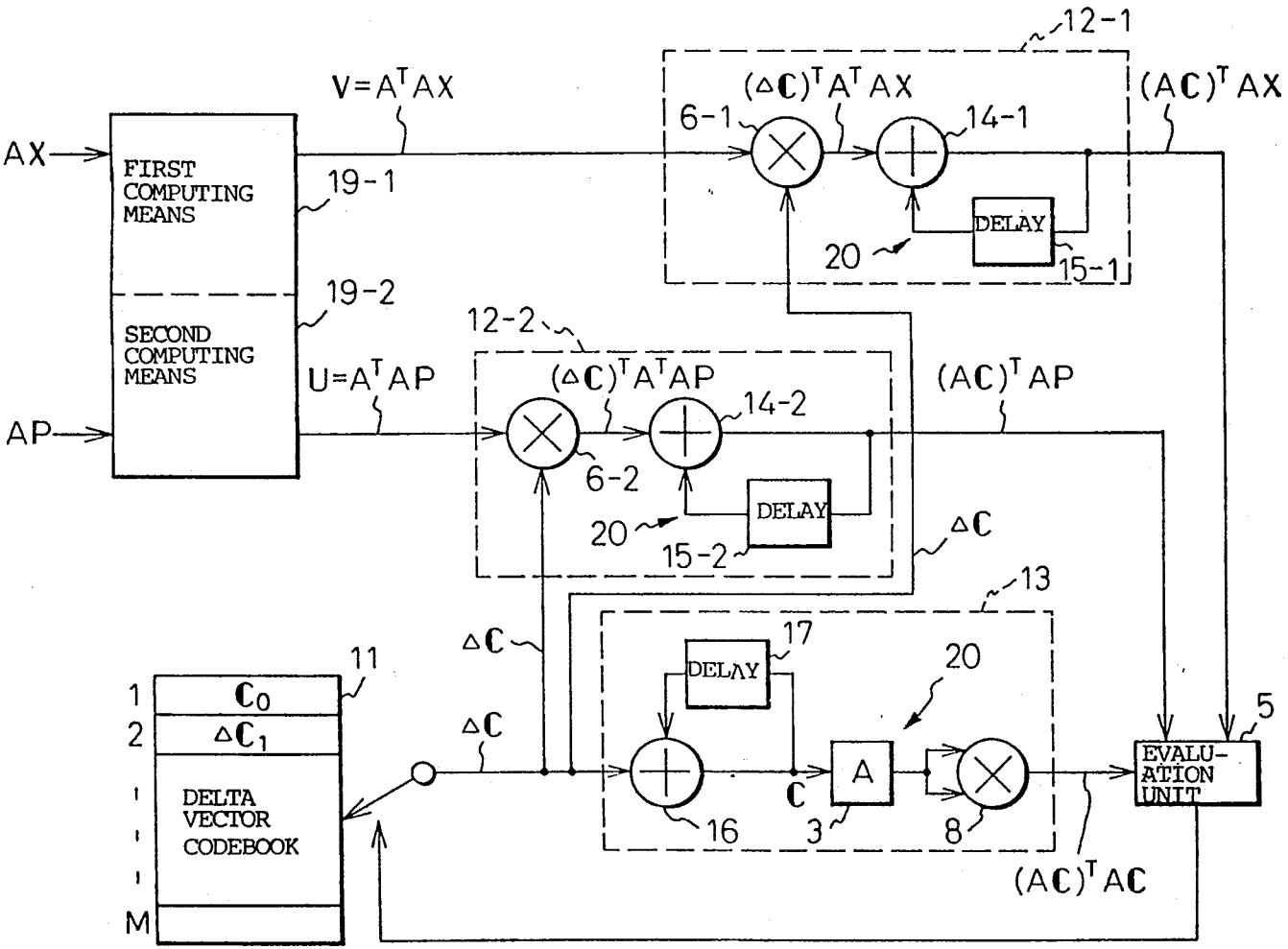
FIG. 7 is a block diagram showing in more detail the portion of the codebook retrieval processing based on the first embodiment using another example.

FIG. 7 is a block diagram showing in more detail the portion of the codebook retrieval processing based on the first embodiment using another example. It shows the case of application to a known simultaneous optimization CELP type speech coder. In the figure too, the first and second computing unit 19-1 and 19-2 are not directly related to the present invention. Note that the cross correlation computation unit (12) performs processing in parallel divided into the input speech system and the pitch P (previously mentioned period) system, so is made the first and second cross correlation computation units 12-1 and 12-2.

The input speech signal vector AX is transformed into $A^TAX$ by the first computing unit 19-1 and the pitch prediction differential vector AP is transformed into $A^TAP$ by the second computing unit 19-2. The delta vectors $\Delta C$ are multiplied by the first and second cross correlation computation units 12-1 and 12-2 and are cyclically added to produce the $(AC)^TAX$ and $(AC)^TAP$. Further, the auto correlation computation unit 13 similarly produces $(AC)^TAC$ and gives the same to the evaluation unit 5, so the amount of computation for just the delta vectors is sufficient.

Figure 8:
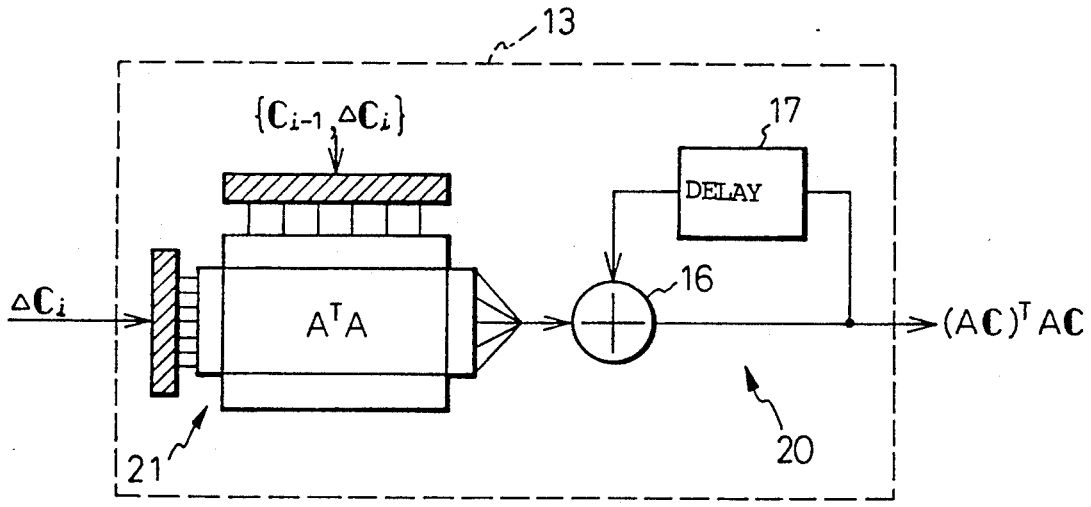
FIG. 8 is a view showing another example of the auto correlation computation unit.

FIG. 8 is a view showing another example of the auto correlation computation unit. The auto correlation computation unit 13 shown in FIG. 6 and FIG. 7 can be realized by another construction as well. The computer 21 shown here is designed so as to deal with the multiplication required in the analysis filter 3 and the auto correlation computation unit 8 in FIG. 6 and FIG. 7 by a single multiplication operation.

In the computer 21, the previous code vectors $C_{i-1}$ and the perceptually weighted matrix A correlation values $A^TA$ are stored. The computation with the delta vectors $\Delta C_i$ is performed and cyclic addition is performed by the adding unit 16 and the delay unit 17 (cyclic adding unit 20), whereby it is possible to find the auto correlation values $(AC)^TAC$.

That is, since $C_{i-1} + \Delta C_i = C_i$, in accordance with the following operation:

$$(AC_i)^TAC_i = (AC_{i-1})^T(AC_{i-1}) + (\Delta C_i)^T(A^TA)C_{i-1} + (\Delta C_i)^T(A^TA)\Delta C_i,$$

the correlation values $A_TA$ and the previous code vectors $C_{i-1}$ are stored and the current auto correlation values $(AC)^TAC$ are produced and can be given to the evaluation unit 5.

If this is done, then the operation becomes merely the multiplication of $A^TA$ and $\Delta C_i$ and $C_{i-1}$. As mentioned earlier, there is no longer a need for two multiplication operations as shown in FIG. 6 and FIG. 7 and the amount of computation can be slashed by that amount.

Figure 9:
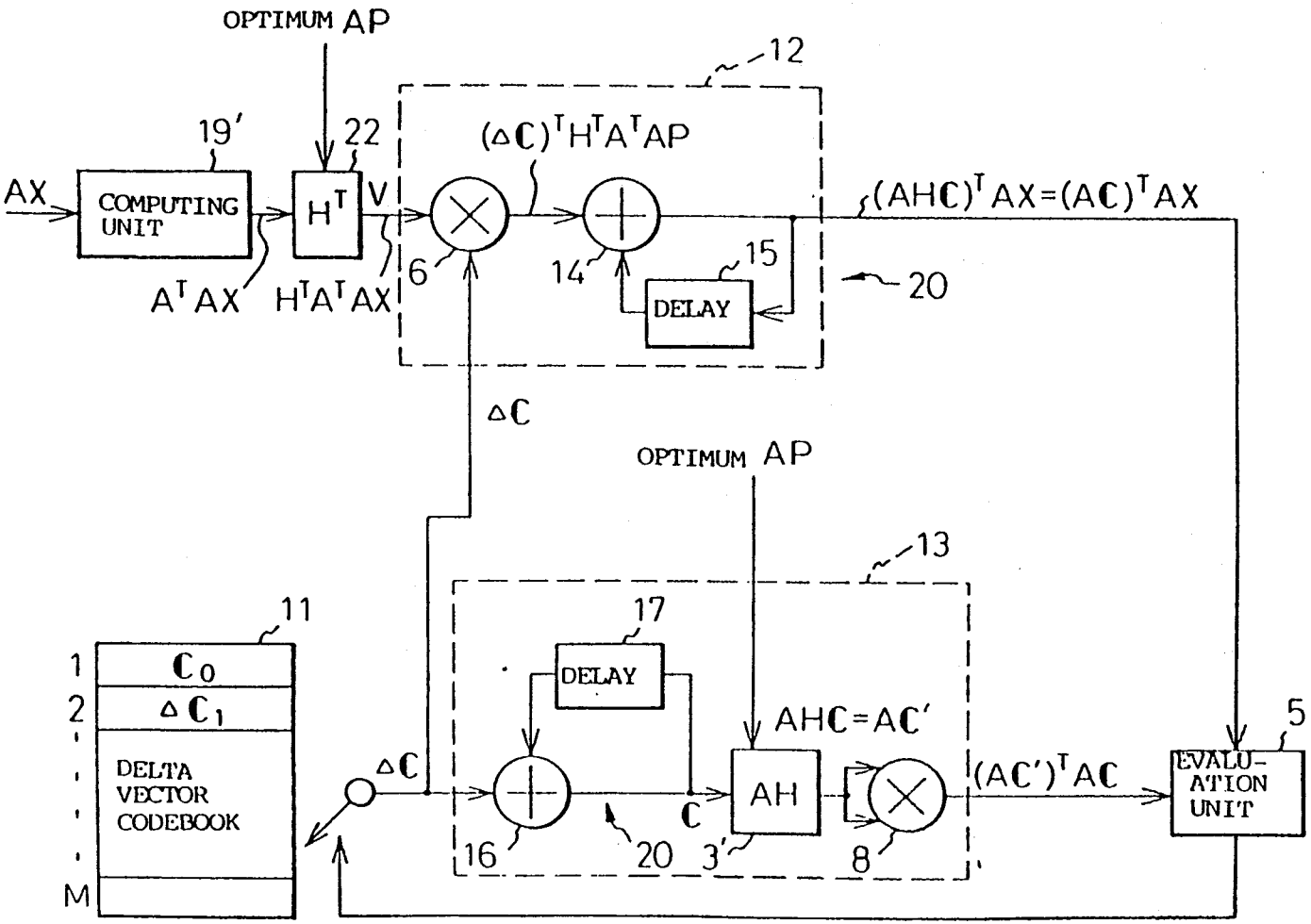
FIG. 9 is a block diagram showing in more detail the portion of the codebook retrieval processing under the first embodiment using another example.

FIG. 9 is a block diagram showing in more detail the portion of the codebook retrieval processing under the first embodiment using another example. Basically, this corresponds to the structure of the previously explained FIG. 3, but FIG. 9 shows an example of application to a pitch orthogonal transformation optimization CELP type speech coder.

In FIG. 9, the block 22 positioned after the computing unit 19' is a time-reversing orthogonal transformation unit. The time-reversing perceptually weighted input speech signal vectors $A^TAX$ are calculated from the perceptually weighted input speech signal vectors AX by the computation unit 19', then the time-reversing perceptually weighted orthogonally transformed input speech signal vectors $(AH)^TAX$ are calculated with respect to the optimal perceptually weighted pitch prediction differential vector AP by the time-reversing orthogonal transformation unit 22. However, the computation unit 19' and the time-reversing orthogonal transformation unit 22 are not directly related to the gist of the present invention.

In the cross correlation computation unit 12, like in the case of FIG. 6 and FIG. 7, multiplication with the delta vectors $\Delta C$ and cyclic addition are performed and the correlation values of $(AHC)^TAX$ are given to the evaluation unit 5. H is the matrix expressing the orthogonal transformation.

The computation at this time becomes:

$$\begin{aligned}(AHC_i)^TAX &= C_i^TH^TA^TAX \\ &= (\Delta C_i)^T(H^TA^TAX) + (AHC_{i-1})^TAX\end{aligned} \quad (11)$$

On the other hand, in the auto correlation computation unit 13, the delta vectors $\Delta C_i$ of the delta vector codebook 11 are cyclically added by the adding unit 16 and the delay unit 17 to produce the code vectors $C_i$, the perceptually weighted and orthogonally transformed code vectors AHC=AC' are calculated with respect to the perceptually weighted (A) pitch prediction differential vectors AP at the optimal time, and the auto correlation values $(AHC)^TAHC=(AC')^TAC'$ of the perceptually weighted orthogonally transformed code vectors AHC are found.

Therefore, even when performing pitch orthogonal transformation optimization, it is possible to slash the amount of computation by the delta vectors in the same way.

Figure 10:
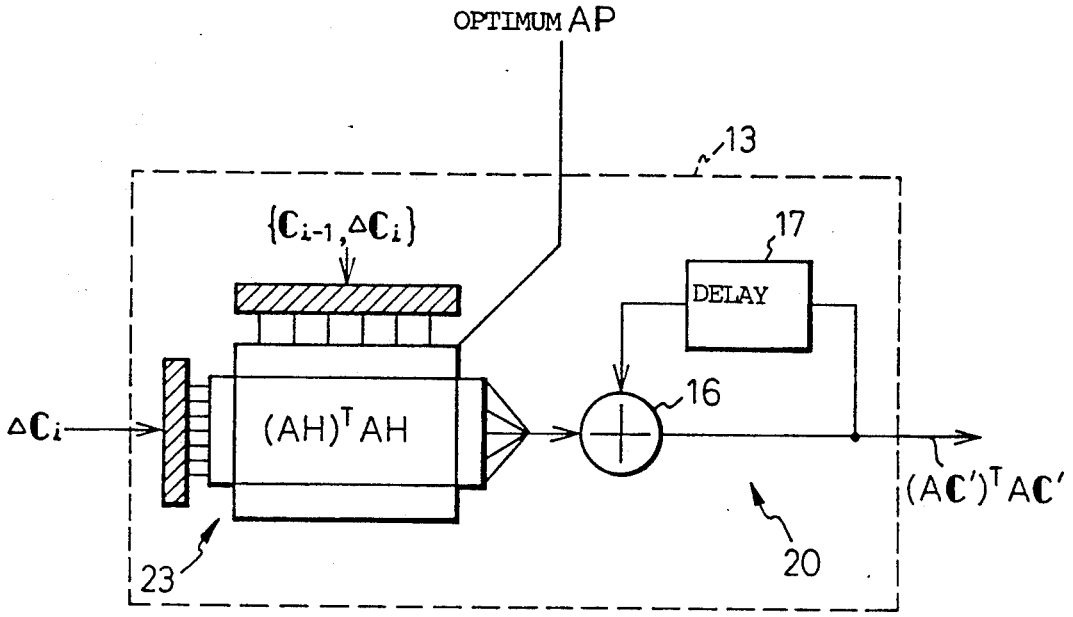
FIG. 10 is a view showing another example of the auto correlation computation unit.

FIG. 10 is a view showing another example of the auto correlation computation unit. The auto correlation computation unit 13 shown in FIG. 9 can be realized by another construction as well. This corresponds to the construction of the above-mentioned FIG. 8.

The computer 23 shown here can perform the multiplication operations required in the analysis filter (AH)3' and the auto correlation computation unit 8 in FIG. 9 by a single multiplication operation.

In the computer 23, the previous code vectors $C_{i-1}$ and the orthogonally transformed perceptually weighted matrix AH correlation values $(AH)^TAH$ are stored, the computation with the delta vectors $\Delta C_i$ is performed, and cyclic addition is performed by the adding unit 16 and the delay unit 17, whereby it is possible to find the auto correlation values comprised of:

$$\begin{aligned}(AHC_i)^TAHC_i = \\ (AHC_{i-1})^T(AHC_{i-1}) + (\Delta C_i)^T((AH)^TAH)C_{i-1}) + \\ (\Delta C_i)^T((AH)^TAH)\Delta C_i\end{aligned} \quad (12)$$

and it is possible to slash the amount of computation. Here, H is changed in accordance with the optimal AP.

The above-mentioned first embodiment gave the code vectors $C_1$, $C_2$, $C_3$ . . . stored in the conventional noise codebook 1 in a virtual manner by linear accumulation of the delta vectors $\Delta C_1$, $\Delta C_2$, $\Delta C_3$ . . . . In this case, the delta vectors are made sparser by taking any four samples in the for example 40 samples as significant data (sample data where the sample value is not zero). Except for this, however, no particular regularity is given in the setting of the delta vectors.

The second embodiment explained next produces the delta vector groups with a special regularity so as to try to vastly reduce the amount of computation required for the codebook retrieval processing. Further, the second embodiment has the advantage of being able to tremendously slash the size of the memory in the delta vector codebook 11. Below the second embodiment will be explained in more detail.

Figure 11:
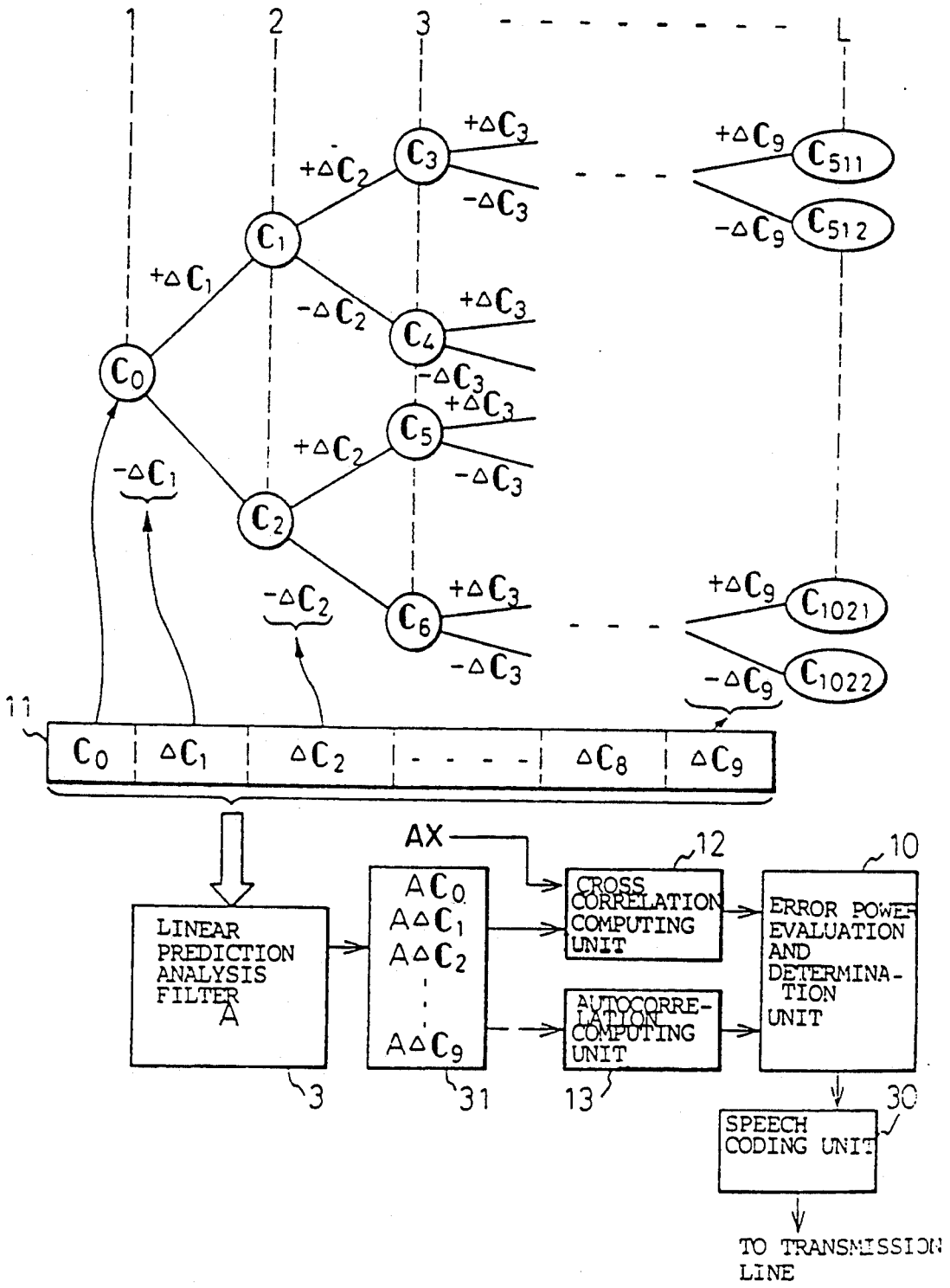
FIG. 11 is a view showing the basic construction of a second embodiment based on the present invention.

FIG. 11 is a view showing the basic construction of the second embodiment based on the present invention. The concept of the second embodiment is shown illustratively at the top half of FIG. 11. The delta vectors for producing the virtually formed, for example, 1024 patterns of code vectors are arranged in a tree-structure with a certain regularity with a + or − polarity. By this, it is possible to resolve the filter computation and the correlation computation with computing on just (L−1) (where L is for example 10) number of delta vectors and it is possible to tremendously reduce the amount of computation.

In FIG. 11, reference numeral 11 is a delta vector codebook storing one reference noise train, that is, the initial vector $C_0$, and the (L−1) types of differential noise trains, the delta vectors $\Delta C_1$ to $\Delta C_{L-1}$ (where L is the number of stages of the tree structure, L=10), 3 is the previously mentioned linear prediction analysis filter (LPC filter) for performing the filter computation processing simulating the speech path characteristics, 31 is a memory unit for storing the filter output $\Delta AC_0$ of the initial vector and the filter outputs $A\Delta C_1$ to $A\Delta C_{L-1}$ of the (L−1) types of data vectors $\Delta C$ obtained by performing filter computation processing by the filter 3 on the initial vector $C_0$ and the (L−1) types of delta vectors $\Delta C_1$ to $\Delta C_{L-1}$, 12 is the previously mentioned cross correlation computation unit which computes the cross correlation $R_{XC}(=(AX)^T(AC))$, 13 is the previously mentioned auto correlation computation unit for computing the auto correlation $R_{CC}$ $(=(AC)^T(AC))$, 10 is the previously mentioned error power evaluation and determination unit for determining the noise train (code vector) giving the largest $R_{XC}^2/R_{CC}$, that is, the smallest error power, and 30 is a speech coding unit which codes the input speech signal by data (code) specifying the noise train (code vector)

giving the smallest error power. The operation of the coder is as follows:

A predetermined single reference noise train, the initial vector $C_0$, and $(L-1)$ types of delta noise trains, the delta vectors $\Delta C_1$ to $\Delta C_{L-1}$ (for example, $L=10$), are vectors $\Delta C_1$ to $\Delta C_{L-1}$ are added (+) and subtracted (−) with the initial vector $C_0$ for each layer, to express the $(2_{10}-1)$ types of noise train code vectors $C_0$ to $C_{1022}$ successively in a tree-structure. Further, a zero vector or $-C_0$ vector is added to these code vectors to express $2_{10}$ patterns of code vectors $C_0$ to $C_{1023}$. If this is done, then by simply storing the initial vector $C_0$ and the $(L-1)$ types of delta vectors $\Delta C_1$ to $\Delta C_{L-1}$ $(L=10)$ in the delta vector codebook 11, it is possible to produce successively $2^L-1$ $(=2^{10}-1=M-1)$ types of code vectors or $2^L$ $(=2^{10}=M)$ types of code vectors, it is possible to make the memory size of the delta vector codebook 11 $L \cdot N$ $(=10 \cdot N)$, and it is possible to strikingly reduce the size compared with the memory size of $M \cdot N$ $(=1024 \cdot N)$ of the conventional noise codebook 1.

Further, the analysis filter 3 performs analysis filter processing on the initial vector $C_0$ and the $(L-1)$ types of delta vectors $\Delta C_1$ to $\Delta C_{L-1}$ $(L=10)$ to find the filter output $AC_0$ of the initial vector and the filter outputs $A\Delta C_1$ to $A\Delta C_{L-1}$ $(L=10)$ of the $(L-1)$ types of delta vectors, which are stored in the memory unit 31. Further, by adding and subtracting the filter output $A\Delta C_1$ of the first delta vector with respect to the filter output $AC_0$ of the initial vector $C_0$, the filter outputs $AC_1$ and $AC_2$ for two types of noise train code vectors $C_1$ and $C_2$ are computed. By adding and subtracting the filter output $A\Delta C_2$ of the second delta vector with respect to the filter outputs $AC_1$ and $AC_2$ for the newly computed noise train code vectors, the filter outputs $AC_3$ to $AC_6$ for the two types of noise train code vectors $C_3$ and $C_4$ and the code vectors $C_5$ and $C_6$ are computed. Below, similarly, the filter output $A\Delta C_{i-1}$ of the $(i-1)$th delta vector is made to act and the filter output $A\Delta C_i$ of the i-th delta vector is made to act on the computed filter output $AC_k$ and the filter outputs $AC_{2k+1}$ and $AC_{2k+2}$ for the two noise train code vectors are computed, thereby generating the filter outputs of all the code vectors. By doing this, the analysis filter computation processing on the code vectors $C_0$ to $C_{1022}$ may be reduced to the analysis filter processing on the initial vector $C_0$ and the $(L-1)$ (for example, $L=10$) types of delta vectors $\Delta C_1$ to $\Delta C_{L-1}$ $(L=10)$ and the $$N_P N \cdot M = (1024 \cdot N_P N)$$

number of multiplication and accumulation operations required in the past for the filter processing may be reduced to $$N_P N \cdot L (= 10 \cdot N_P N)$$

number of multiplication and accumulation operations.

Further, the noise train (code vector) giving the smallest error power is determined by the error power evaluation and determination unit 10 and the code specifying the code vector is output by the speech coding unit 30 for speech coding. The processing for finding the code vector giving the smallest error power is reduced to finding the code vector giving the largest ratio of the square of the cross correlation $R_{XC}$ $(=AX)^T(AC)$, T being a transposed matrix) between the analysis filter computation output AC and the input speech signal vector AX and the auto correlation $R_{CC}(=(AC)\cdot(AC))$ of the output of the analysis filter. Further, using the analysis filter computation output $AC_k$ of one layer earlier and the present delta vector filter output $A\Delta C_i$ to express the analysis filter computation outputs $AC_{2k+1}$ and $AC_{2k+2}$ by the recurrence equations as shown below, $$AC_{2k+1} = AC_k + A\Delta C_i$$

$$AC_{2k+2} = AC_k - A\Delta C_i \tag{12}$$

the cross correlation $R_{XC}^{(2k+1)}$ and $R_{XC}^{(2k+2)}$ are expressed by the recurrence equations as shown by the following:

$$R_{XC}^{(2k+1)} = R_{XC}^{(k)} + (AX)^T(A\Delta C_i)$$

$$R_{XC}^{(2k+2)} = R_{XC}^{(k)} - (AX)^T(A\Delta C_i) \tag{13}$$

and the cross correlation $R_{XC}^{(k)}$ of one layer earlier is used to calculate the present cross correlation $R_{XC}^{(2k+1)}$ and $R_{XC}^{(2k+2)}$ by the cross correlation computation unit 12. If this is done, then it is possible to compute the cross correlation between the filter outputs of all the code vectors and the input speech signal AX by just computing of the cross correlation of the second term on the right side of equations (13). That is, while it had been necessary to perform $M \cdot N$ $(=1024 \cdot N)$ multiplication and accumulation operations to find the cross correlation in the past, it is possible to just perform $L \cdot N$ $(=10 \cdot N)$ multiplication and accumulation operations and to tremendously reduce the number of computations.

Further, the auto correlation computation unit 13 is designed to compute the present cross correlations $R_{CC}^{(2k+1)}$ and $R_{CC}^{(2k+2)}$ using the $R_{CC}^{(k)}$ of one layer earlier. If this is done, then it is possible to compute the auto correlations $R_{CC}$ using the total L number of auto correlations $(AC_0)^2$ and $(A\Delta C_1)^2$ to $(A\Delta C_{L-1})^2$ of the filter output $AC_0$ of the initial vector and the filter outputs $A\Delta C_1$ to $A\Delta C_{L-1}$ of the $(L-1)$ types of delta vectors and the $(L^2-1)/2$ cross correlations with the filter outputs $AC_0$ and $A\Delta C_1$ to $A\Delta C_{L-1}$. That is, while it took $M \cdot N$ $(=1024 \cdot N)$ number of multiplication and accumulation operations to find the auto correlation in the past, it becomes possible to find it by just $L(L+1) \cdot N/2$ $(=55 \cdot N)$ number of multiplication and accumulation operations and the number of computations can be tremendously reduced.

Figure 12:
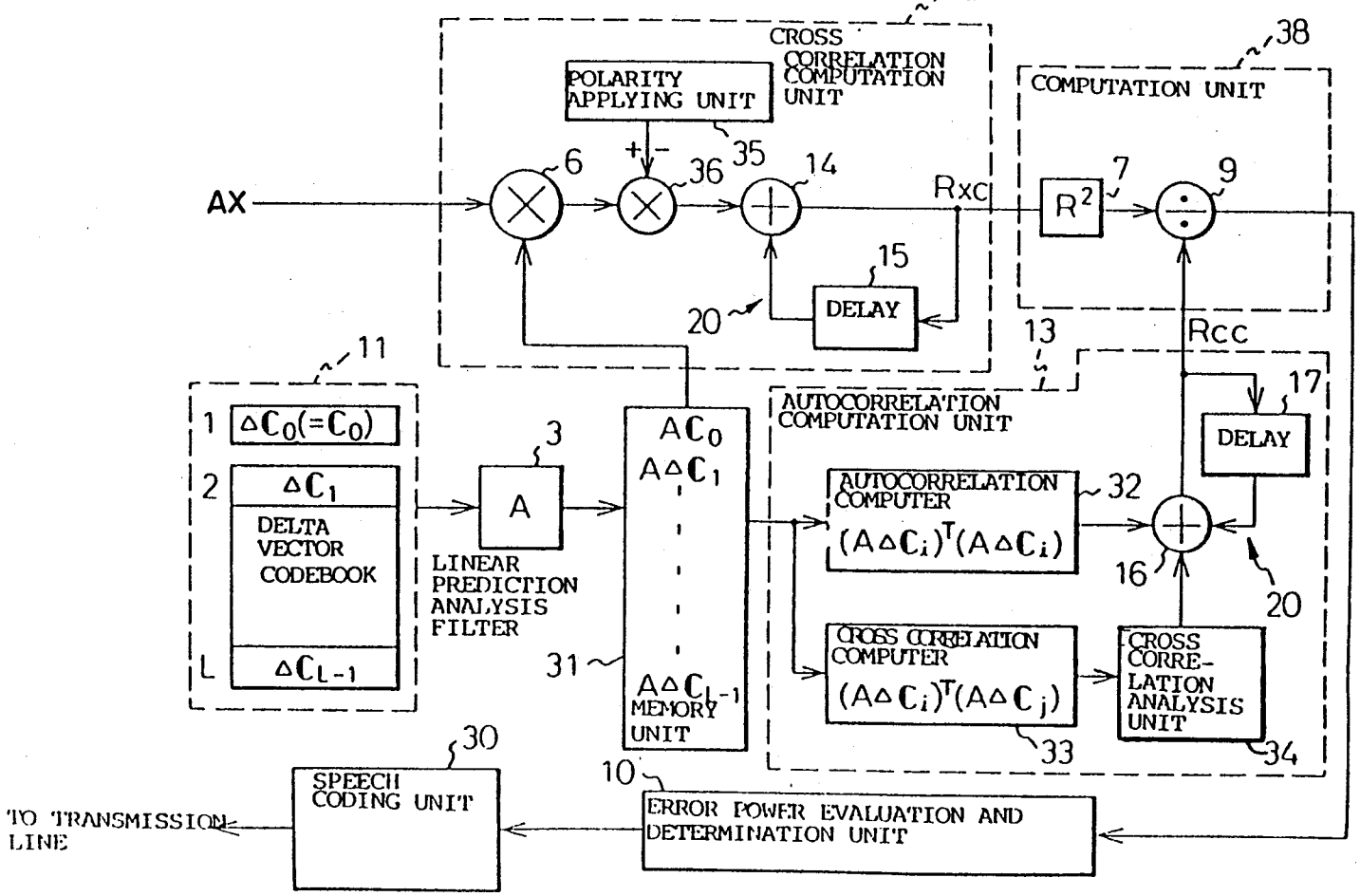
FIG. 12 is a view showing in more detail the second embodiment of FIG. 11.

FIG. 12 is a view showing in more detail the second embodiment of FIG. 11. As mentioned earlier, 11 is the delta vector codebook for storing and holding the initial vector $C_0$ expressing the single reference noise train and the delta vectors $\Delta C_1$ to $\Delta C_{L-1}$ $(L=10)$ expressing the $(L-1)$ types of differential noise trains. The initial vector $C_0$ and the delta vectors $\Delta C_1$ to $\Delta C_{L-1}$ $(L=10)$ are expressed in N dimensions. That is, the initial vector and the delta vectors are N dimensional vectors obtained by coding the amplitudes of the N number of sampled noise generated in a time series. Reference numeral 3 is the previously mentioned linear prediction analysis filter (LPC filter) which performs filter computation processing simulating the speech path characteristics. It is comprised of an $N_P$ order IIR (infinite impulse response) type filter. An $N \times N$ square matrix A and code vector C matrix computation is performed to perform analysis filter processing on the code vector C. The $N_P$ number of coefficients of the IIR type filter differs based on the input speech signal AX and is determined by a known method with each occurrence. That is, there is correlation between adjoining samples of input speech signals, so the coefficient of correlation between the samples is found, the partial auto correlation coefficient, known as the Parcor coefficient, is found from the coefficient of correlation, the $\alpha$ coefficient of the IIR filter is determined from the Parcor coefficient, the N×N square matrix A is prepared using the impulse response train of the filter, and analysis filter processing is performed on the code vector.

Reference numeral 31 is a memory unit for storing the filter outputs $AC_0$ and $A\Delta C_1$ to $A\Delta C_{L-1}$ obtained by performing the filter computation processing on the initial vector $C_0$ expressing the reference noise train and the delta vectors $\Delta C_1$ to $\Delta C_{L-1}$ expressing the (L−1) types of delta noise trains, 12 is a cross correlation computation unit for computating the cross correlation $R_{XC}(=(AX)^T(AC))$, 13 is an auto correlation computation unit for computing the auto correlation $R_{CC}$ $(=(AC)^T(AC))$, and 38 is a computation unit for computing the ratio between the square of the cross correlation and the auto correlation.

The error power $|E|^2$ is expressed by the above-mentioned equation (3), so the code vector C giving the smallest error power gives the largest second term on the right side of equation (3). Therefore, the computation unit 38 is provided with the square computation unit 7 and the division unit 9 and computes the following equation:

$$F(X,C)=R_{XC}^2/R_{CC} \tag{14}$$

Reference numeral 10, as mentioned earlier, is the error power evaluation and determination unit which determines the noise train (code vector) giving the largest $R_{XC}^2/R_{CC}$, in other words, the smallest error power, and 30 is a speech coding unit which codes the input speech signals by a code specifying the noise train (code vector) giving the smallest error power.

Figure 13:
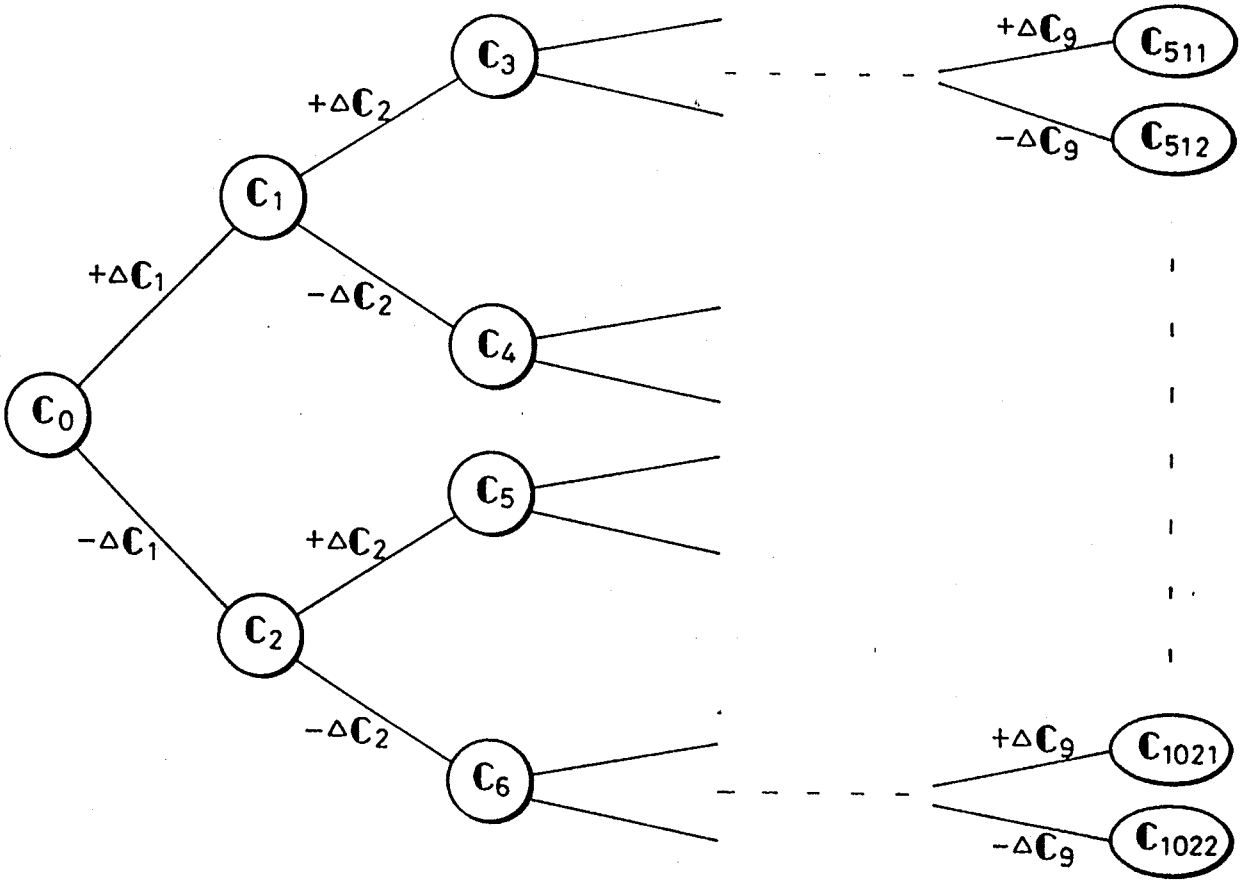
FIG. 13 is a view for explaining the tree-structure array of delta vectors characterizing the second embodiment.

FIG. 13 is a view for explaining the tree-structure array of delta vectors characterizing the second embodiment. The delta vector codebook 11 stores a single initial vector $C_0$ and (L−1) types of delta vectors $\Delta C_1$ to $\Delta C_{L-1}$ (L=10). The delta vectors $\Delta C_1$ to $\Delta C_{L-1}$ are added (+) or subtracted (−) at each layer with respect to the initial vector $C_0$ so as to virtually express $(2^{10}-1)$ types of code vectors $C_0$ to $C_{1022}$ successively in a tree-structure. Zero vectors (all sample values of N dimensional samples being zero) are added to these code vectors to express $2^{10}$ code vectors $C_0$ to $C_{1023}$. If this is done, then the relationships among the code vectors are expressed by the following:

$$C_0 = C_0 \quad \text{I} \tag{15}$$

$$\left.\begin{aligned} C_1 &= C_0 + \Delta C_1 \\ C_2 &= C_0 - \Delta C_1 \end{aligned}\right\} \text{II}$$

$$\left.\begin{aligned} C_3 &= C_1 + \Delta C_2\ (=C_0 + \Delta C_1 + \Delta C_2) \\ C_4 &= C_1 - \Delta C_2\ (=C_0 + \Delta C_1 - \Delta C_2) \\ C_5 &= C_2 + \Delta C_2\ (=C_0 - \Delta C_1 + \Delta C_2) \\ C_6 &= C_2 - \Delta C_2\ (=C_0 - \Delta C_1 - \Delta C_2) \\ &\vdots \end{aligned}\right\} \text{III}$$

-continued $$\left.\begin{aligned} C_{511} &= C_{255} + \Delta C_9\ (=C_0 + \Delta C_1 + \Delta C_2 + \ldots + \Delta C_9) \\ C_{512} &= C_{255} - \Delta C_9\ (=C_0 + \Delta C_1 + \Delta C_2 + \ldots - \Delta C_9) \\ &\vdots \\ C_{1021} &= C_{510} + \Delta C_9\ (=C_0 - \Delta C_1 - \Delta C_2 - \ldots + \Delta C_9) \\ C_{1022} &= C_{510} - \Delta C_9\ (=C_0 - \Delta C_1 - \Delta C_2 - \ldots - \Delta C_9) \end{aligned}\right\} \text{X}$$

(where I is the first layer, II is the second layer, III is the third layer, and X is the 10th layer) and in general may be expressed by the recurrence equations of $$C_{2k+1}C_k+\Delta C_i \tag{16}$$

$$C_{2k+2}C_k-\Delta C_i \tag{17}$$

That is, by just storing the initial vector $C_0$ and the (L−1) types of delta vectors $\Delta C$ to $\Delta C_{L-1}$ (L=10) in the delta vector codebook 11, it is possible to virtually produce successively any of $2^L$ $(=2^{10})$ types of noise train code vectors, it is possible to make the size of the memory of the delta vector codebook 11 L·N (=10·N), and it is possible to tremendously reduce the memory size from the memory size N·N (=1024·N) of the conventional noise codebook.

Next, an explanation will be made of the filter processing at the linear prediction analysis filter (A) (filter 3 in FIG. 12) on the code vector $C_{2k+1}$ and $C_{2k+2}$ expressed generally by the above equation (16) and equation (17).

The analysis filter computation outputs $AC_{2k+1}$ and $AC_{2k+2}$ with respect to the code vectors $C_{2k+1}$ and $C_{2k+2}$ may be expressed by the recurrence equations of $$AC_{2k+1}=A(C_k+\Delta C_i)=AC_k+A\Delta C_i \tag{18}$$

$$AC_{2k+2}=A(C_k-\Delta C_i)=AC_k-A\Delta C_i \tag{19}$$

where $i=1, 2, \ldots L-1$, $2^{i-1}\leqq k<2^i-1$

Therefore, if analysis filter processing is performed by the analysis filter 3 on the initial vector $C_0$ and the (L−1) types of delta vectors $\Delta C_1$ to $\Delta C_{L-1}$ (L=10) and the filter output $AC_0$ of the initial vector and the filter outputs $A\Delta C_1$ to $A\Delta C_{L-1}$ (L=10) of the (L−1) types of delta vectors are found and stored in the memory unit 31, it is possible to reduce the filter processing on the code vectors of all the noise trains as indicated below.

That is, (1) by adding or subtracting for each dimension the filter output $A\Delta C_1$ of the first delta vector with respect to the filter output $AC_0$ of the initial vector, it is possible to compute the filter outputs $AC_1$ and $AC_2$ with respect to the code vectors $C_1$ and $C_2$ of two types of noise trains. Further, (2) by adding or subtracting the filter output $A\Delta C_2$ of the second delta vector with respect to the newly computed filter computation outputs $AC_1$ and $AC_2$, it is possible to compute the filter outputs $AC_1$ to $AC_6$ with respect to the respectively two types, or total four types, of code vectors $C_3$, $C_4$, $C_5$, and $C_6$. Below, similarly, (3) by making the filter output $A\Delta C_i$ of the i-th delta vector act on the filter output $AC_k$ computed by making the filter output $A\Delta C_{i-1}$ of the (i−1)th delta vector act and computing the respectively two types of filter outputs $AC_{2k+1}$ and $AC_{2k+2}$, it is possible to produce filter outputs for the code vectors of all the $2^L$ $(=2^{10})$ noise trains.

That is, by using the tree-structure delta vector codebook 11 of the present invention, it becomes possible to recurrently perform the filter processing on the code vectors by the above-mentioned equations (18) and (19). By just performing analysis filter processing on the initial vector $C_0$ and the $(L-1)$ types of delta vectors $\Delta C_1$ to $\Delta C_{L-1}$ $(L=10)$ and adding while changing the polarities $(+, -)$, filter processing is obtained on the code vectors of all the noise trains.

In actuality, in the case of the delta vector codebook 11 of the second embodiment, as mentioned later, in the computation of the cross correlation $R_{XC}$ and the auto correlation $R_{CC}$, filter computation output for all the code vectors is unnecessary. It is sufficient if only the results of filter computation processing be obtained for the initial vector $C_0$ and the $(L-1)$ types of delta vectors $\Delta C_1$ to $\Delta C_{L-1}$ $(L=10)$.

Therefore, the analysis filter computation processing on the code vectors $C_0$ to $C_{1023}$ (noise codebook 1) in the past can be reduced to analysis filter computation processing on the initial vector $C_0$ and the $(L-1)$ types of delta vectors $\Delta C_1$ to $\Delta C_{L-1}$ $(L=10)$. Therefore, while the filter processing required $$N_P \cdot N \cdot M (=1024 \cdot N_P \cdot N)$$

number of multiplication and accumulation operations in the past, in the present embodiment it may be reduced to $$N \cdot N \cdot L (=10 \cdot N_P \cdot N)$$

number of multiplication and accumulation operations.

Next, an explanation will be made of the calculation of the cross correlation $R_{XC}$.

If the analysis filter computation outputs $AC_{2k+1}$ and $AC_{2k+2}$ are expressed by recurrence equations as shown in equations (18) and (19) using the one previous analysis filter computation output $AC_k$ and the filter output $A\Delta C_i$ of the present delta vector, the cross correlation $R_{XC}^{(2k+1)}$ and $R_{XC}^{(2k+2)}$ may be expressed by the recurrence equations as shown below:

$$\begin{aligned} R_{XC}^{(2k+1)} &= (AX^T)(AC_{2k+1}) \\ &= (AX^T)(AC_k) + (AX^T)(A\Delta C_i) \\ &= R_{XC}^{(k)} + (AX^T)(A\Delta C_i) \end{aligned} \tag{20}$$

$$\begin{aligned} R_{XC}^{(2k+2)} &= (AX^T)(AC_{2k+2}) \\ &= (AX^T)(AC_k) - (AX^T)(A\Delta C_i) \\ &= R_{XC}^{(k)} - (AX^T)(A\Delta C_i) \end{aligned} \tag{21}$$

Therefore, it is possible to compute the present cross correlations $R_{XC}^{(2k+1)}$ and $R_{XC}^{(2k+2)}$ using the cross correlation $R_{XC}^{(8)}$ (i.e., $R_{XC}^{(k)}$ where $k=8$) of one previous layer by the cross correlation computation unit 12. If this is done, then it is sufficient to just perform the cross correlation computation of the second term on the right side of equations (20) and (21) to compute the cross correlation between the filter outputs of the code vectors of all the noise trains and the input speech signal AX. That is, while the conventional computation of the cross correlation required $$M \cdot N (=1024 \cdot N)$$

number of multiplication and accumulation operations, according to the second embodiment, it is possible to do this by just $$L \cdot N (=10 \cdot N)$$

number of multiplication and accumulation operations and therefore to tremendously reduce the number of computations.

Note that in FIG. 12, reference numeral 6 indicates a multiplying unit to compute the right side second term $(AX)^T(A\Delta C_i)$ of the equations (20) and (21), 35 is a polarity applying unit for producing $+1$ and $-1$, 36 is a multiplying unit for multiplying the polarity $\pm 1$ to give polarity to the second term of the right side, 15 is the previously mentioned delay unit for given a predetermined time of memory delay to the one previous correlation $R_{XC}^{(k)}$, and 14 is the previously mentioned adding unit for performing addition of the first term and second term on the right side of the equations (20) and (21) and outputting the present cross correlations $R_{XC}^{(2k+1)}$ and $R_{XC}^{(2k+2)}$.

Next, an explanation will be made of the calculation of the auto correlation $R_{CC}$.

If the analysis filter computation outputs $AC_{2k+1}$ and $AC_{2k+2}$ are expressed by recurrence equations as shown in the above equations (18) and (19) using the one previous layer analysis filter computation output $AC_k$ and the present delta vector filter output $A\Delta C_i$, the auto correlations $R_{CC}$ for the code vectors of the noise trains are expressed by the following equations.

That is, they are expressed by:

$$\begin{aligned}
R_{CC}^{(0)} &= (AC_0)^T(AC_0) \\
AC_1 &= AC_0 + A\Delta C_1 \\
R_{CC}^{(1)} &= (AC_0)^T(AC_0) + (A\Delta C_1)^T(A\Delta C_1) + 2(AC_0)^T(A\Delta C_1) \\
R_{CC}^{(2)} &= (AC_0)^T(AC_0) + (A\Delta C_1)^T(A\Delta C_1) - 2(AC_0)^T(A\Delta C_1) \\
AC_3 &= AC_1 + A\Delta C_2 = AC_0 + A\Delta C_1 + A{:}C_2 \\
AC_4 &= AC_1 - A\Delta C_2 = AC_0 + A\Delta C_1 - A{:}C_2 \\
AC_5 &= AC_2 + A\Delta C_2 = AC_0 - A\Delta C_1 + A{:}C_2 \\
AC_6 &= AC_1 - A\Delta C_2 = AC_0 - A\Delta C_1 1A{:}C_2 \\
R_{CC}^{(3)} &= (AC_0)^T(AC_0) + (A\Delta C_1)^T(A\Delta C_1) + (A\Delta C_2)^T(A\Delta C_2) + 2(AC_0)^T(A\Delta C_1) + 2(A\Delta C_1)^T(A\Delta C_2) + 2(A\Delta C_2)^T(AC_0) \\
R_{CC}^{(4)} &= (AC_0)^T(AC_0) + (A\Delta C_1)^T(A\Delta C_1) + (A\Delta C_2)^T(A\Delta C_2) + 2(AC_0)^T(A\Delta C_1) - 2(A\Delta C_1)^T(A\Delta C_2) - 2(A\Delta C_2)^T(AC_0) \\
R_{CC}^{(5)} &= (AC_0)^T(AC_0) + (A\Delta C_1)^T(A\Delta C_1) + (A\Delta C_2)^T(A\Delta C_2) - 2(AC_0)^T(A\Delta C_1) - 2(A\Delta C_1)^T(A\Delta C_2) + 2(A\Delta C_2)^T(AC_0) \\
R_{CC}^{(6)} &= (AC_0)^T(AC_0) + (A\Delta C_1)^T(A\Delta C_1) + (A\Delta C_2)^T(A\Delta C_2) - 2(AC_0)^T(A\Delta C_1) + 2(A\Delta C_1)^T(A\Delta C_2) - 2(A\Delta C_2)^T(AC_0)
\end{aligned} \tag{22}$$

and can be generally expressed by $$R_{CC}^{(2k+1)} = R_{CC}^{(k)} + (A\Delta C_i)^T(A\Delta C_i) + 2A\Delta C_i \cdot AC_k \tag{23}$$

$$R_{CC}^{(2k+2)}=R_{CC}^{(k)}+(A\Delta C_i)^T(A\Delta C_i)-2A\Delta C_i\cdot AC_k \quad (24)$$

That is, by adding the presenct cross correlation $(A\Delta C_i)^T(A\Delta C_i)$ of the $A\Delta C_i$ to the auto correlation $R_{CC}^{(k)}$ of one layer before and by adding the cross correlations of $A\Delta C_i$ and $AC_0$ and $A\Delta C_i$ to $A\Delta C_{i-1}$ while changing the polarities (+, −), it is possible to compute the cross correlations $R_{CC}^{(2k+1)}$ and $R_{CC}^{(2k+2)}$. By doing this, it is possible to compute the auto correlations $R_{CC}$ by using the total L number of auto correlations $(AC_0)^2$ and $(A\Delta C_1)^2$ to $(A\Delta C_{L-1})^2$ of the filter output $AC_0$ of the initial vector and the filter outputs $A\Delta C_1$ to $A\Delta C_{L-1}$ of the (L−1) types of delta vectors and the $(L^2-1)/2$ cross correlations among the filter outputs $AC_0$ and $A\Delta C_1$ to $A\Delta C_{L-1}$. That is, it is possible to perform the computation of the cross correlation, which required $$M\cdot N(=1024\cdot N)$$

number of multiplication and accumulation operations in the past, by just $$L(L+1)\cdot N/2(=55\cdot N)$$

number of multiplication and accumulation operations and therefore it is possible to tremendously reduce the number of computations. Note that in FIG. 12, 32 indicates an auto correlation computation unit for computing the auto correlation $(A\Delta C_i)^T(A\Delta C_i)$ of the second term on the right side of equations (23) and (24), 33 indicates a cross correlation computation unit for computing the cross correlations in equations (23) and (24), 34 indicates a cross correlation analysis unit for adding the cross correlations with predetermined polarities (+, −), 16 indicates the previously mentioned adding unit which adds the auto correlation $R_{CC}^{(k)}$ of one layer before, the auto correlation $(A\Delta C_i)^T(A\Delta C_i)$, and the cross correlations to compute equations (23) and (24), and 17 indicates the previously mentioned delay unit which stores the auto correlation $R_{CC}^{(k)}$ of one layer before for a predetermined time to delay the same.

Finally, an explanation will be made of the operation of the circuit of FIG. 12 as a whole.

A previously decided single reference noise train, that is, the initial vector $C_0$, and the (L−1) types of differential noise trains, that is, the delta vectors $\Delta C_1$ to $\Delta C_{L-1}$ (for example, L=10), are stored in the delta vector codebook 11, analysis filter processing is applied in the linear prediction analysis (LPC) filter 3 to the initial vector $C_0$ and the (L−1) types of delta vectors $\Delta C_1$ to $\Delta C_{L-1}$ (L=10) to find the filter outputs $AC_0$ and $A\Delta C_1$ to $A\Delta C_{L-1}$ (L=10), and these are stored in the memory unit 31.

In this state, using i=0 and k=0, the cross correlation $$R_{XC}^{(0)}(AX)^T(AC_0)$$

is computed in the cross correlation computation unit 12, the auto correlation $$R_{CC}^{(0)}(=(AC_0)^T(AC_0))$$

is computed in the auto correlation computation unit 13, and these cross correlation and auto correlation are used to compute F(X,C) $(=R_{XC}^2/R_{CC})$ by the above-mentioned equation (14) by the computation unit 38.

The error power evaluation and determination unit 10 compares the computed computation value F(X,C) with the maximum value $F_{max}$ (initial value of 0) of the F(X,C) up to then. If F(X,C) is greater than $F_{max}$, then F(X,C) is made $F_{max}$ to update the $F_{max}$ and the codes up to then are updated using a code (index) specifying the single code vector giving this $F_{max}$.

If the above processing is performed on the $2^i(=2^0)$ number of code vectors, then using i=1, the cross correlation is computed in accordance with the above-mentioned equation (20) (where, k=0 and i=1), the auto correlation is computed in accordance with the above-mentioned equation (23), and the cross correlation and auto correlation are used to compute the above-mentioned equation (14) by the computation unit 38.

The error power evaluation and determination unit 10 compares the computed computation value F(X,C) with the maximum value $F_{max}$ (initial value of 0) of the F(X,C) up to then. If F(X,C) is greater than $F_{max}$, then F(X,C) is made $F_{max}$ to update the $F_{max}$ and the codes up to then are updated using a code (index) specifying the single code vector giving this $F_{max}$.

Next, the cross correlation is computed in accordance with the above-mentioned equation (21) (where, k=0 and i=1), the auto correlation is computed in accordance with the above-mentioned equation (24), and the cross correlation and auto correlation are used to compute the above-mentioned equation (14) by the computation unit 38.

The error power evaluation and determination unit 10 compares the computed computation value F(X,C) with the maximum value $F_{max}$ (initial value of 0) of the F(X,C) up to then. If F(X,C) is greater than $F_{max}$, then F(X,C) is made $F_{max}$ to update the $F_{max}$ and the codes up to then are updated using a code (index) specifying the single code vector giving this $F_{max}$.

If the above processing is performed on the $2^i(=2^1)$ number of code vectors, then using i=2, the same processing as above is repeated. If the above processing is performed on all of the $2^{10}$ number of code vectors, the speech coder 30 outputs the newest code (index) stored in the error power evaluation and determination unit 10 as the speech coding information for the input speech signal.

Next, an explanation will be made of a modified second embodiment corresponding to a modification of the above-mentioned second embodiment. In the above-mentioned second embodiment, all of the code vectors were virtually reproduced by just holding the initial vector $C_0$ and a limited number (L−1) number of delta vectors $(\Delta C_i)$, so this was effective to reduce the amount of computations and further to slashing the size of the memory of the codebook.

However, if one looks at the components of the vectors of the delta vector codebook 11, then, as shown by the above-mentioned equation (15), the component of $C_0$, or the initial vector, is included in all of the vectors, while the component of the lowermost layer, that is, the component of the ninth delta vector $\Delta C_9$, is included in only half, or 512 vectors (see FIG. 13). That is, the contributions of the delta vectors to the composition of the codebook 11 are not equal. The higher the layer of the tree structure array which the delta vector constitutes, for example, the initial vector $C_0$ and the first delta vector $\Delta C_1$, the more code vectors in which the vectors are included as components, which may be said to determine the mode of the distribution of the codebook.

Figure 14A:
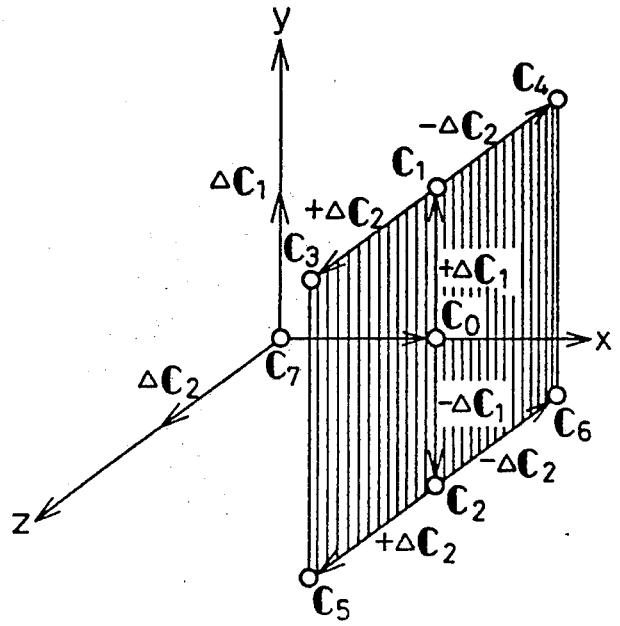
FIGS. 14A, 14B, and 14C are views showing the distributions of the code vectors virtually created in the codebook (mode A, mode B, and mode C)
Figure 14B:
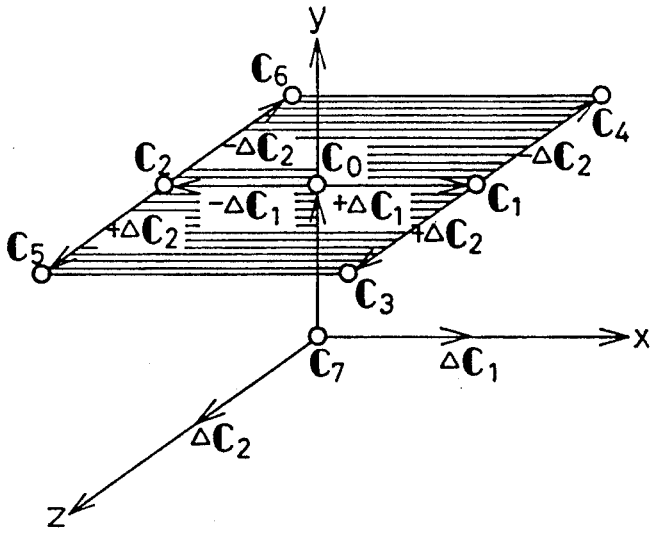
Figure 14C:
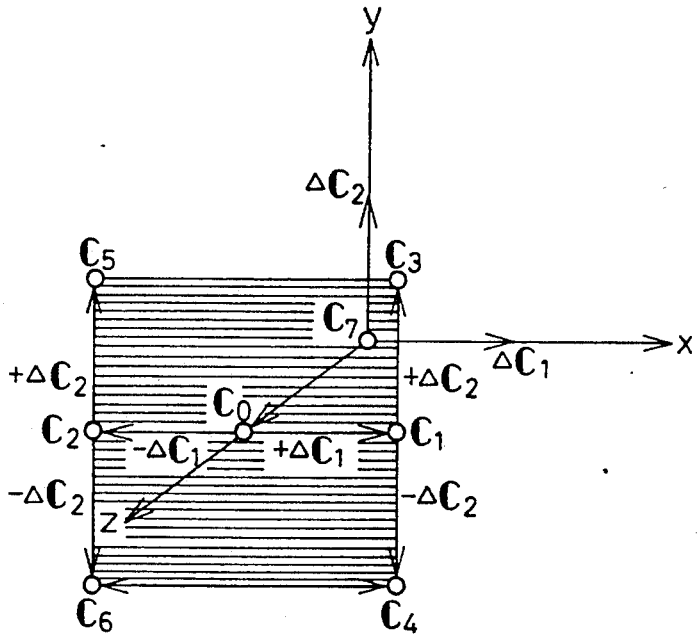

FIGS. 14A, 14B, and 14C are views showing the distributions of the code vectors virtually formed in the codebook (mode A, mode B, and mode C). For example, considering three vectors, that is, $C_0$, $\Delta C_1$, and $\Delta C_2$, there are six types of distribution of the vectors (mode A to mode F). FIG. 14A to FIG. 14C show mode A to mode C, respectively. In the figures, $e_x$, $e_y$, and $e_z$ indicate unit vectors in the x-axial, y-axial, and z-axial directions constituting the three dimensions. The remaining modes D, E, and F correspond to allocations of the following unit vectors to the vectors:

Mode D: $C_0=e_x$, $\Delta C_1=e_z$, $\Delta C_2=e_y$

Mode E: $C_0=e_y$, $\Delta C_1=e_z$, $\Delta C_2=e_x$

Mode F: $C_0=e_z$, $\Delta C_1=e_x$, $\Delta C_2=e_y$

Therefore, it is understood that there are delta vector codebooks 11 with different distributions of modes depending on the order of the vectors given as delta vectors. That is, if the order of the delta vectors is allotted in a fixed manner at all times as shown in FIG. 13, then only code vectors constantly biased toward a certain mode can be reproduced and there is no guarantee that the optimal speech coding will be performed on the input speech signal AX covered by the vector quantization. That is, there is a danger of an increase in the quantizing distortion.

Therefore, in the modified second embodiment of the present invention, by rearranging the order of the total L number of vectors given as the initial vector $C_0$ and the delta vectors $\Delta C$, the mode of the distribution of the code vectors virtually created in the codebook 1 may be adjusted. That is, the properties of the codebook may be changed.

Further, the mode of the distribution of the code vectors may be adjusted to match the properties of the input speech signal to be coded. This enables a further improvement of the quality of the reproduced speech.

In this case, the vectors are rearranged for each frame in accordance with the properties of the linear prediction analysis (LPC) filter 3. If this is done, then at the side receiving the speech coding data, that is, the decoding side, it is possible to perform the exact same adjustment (rearrangement of the vectors) as performed at the coder side without sending special adjustment information from the coder side.

As a specific example, in performing the rearrangement of the vectors, the powers of the filter outputs of the vectors obtained by applying linear prediction analysis filter processing on the initial vector and delta vectors are evaluated and the vectors are rearranged in the order of the initial vector, the first delta vector, the second delta vector... successively from the vectors with the greater increase in power compared with the power before the filter processing.

In the above-mentioned rearrangement, the vectors are transformed in advance so that the initial vector and the delta vectors are mutually orthogonal after the linear prediction analysis filter processing. By this, it is possible to uniformly distribute the vectors virtually formed in the codebook 11 on a hyper plane.

Further, in the above-mentioned rearrangement, it is preferable to normalize the powers of the initial vector and the delta vectors. This enables rearrangement by just a simple comparison of the powers of the filter outputs of the vectors.

Further, when transmitting the speech coding data to the receiver side, codes are allotted to the speech coding data so that the intercode distance (vector Euclidean distance) between vectors belonging to the higher layers in the tree-structure vector array become greater than the intercode distance between vectors belonging to the lower layers. This takes note of the fact that the higher the layer to which a vector belongs (initial vector and first delta vector etc.), the greater the effect on the quality of the reproduced speech obtained by decoding on the receiver side. This enables the deterioration of the quality of the reproduced speech to be held to a low level even if transmission error occurs on the transmission path to the receiver side.

Figure 15A:
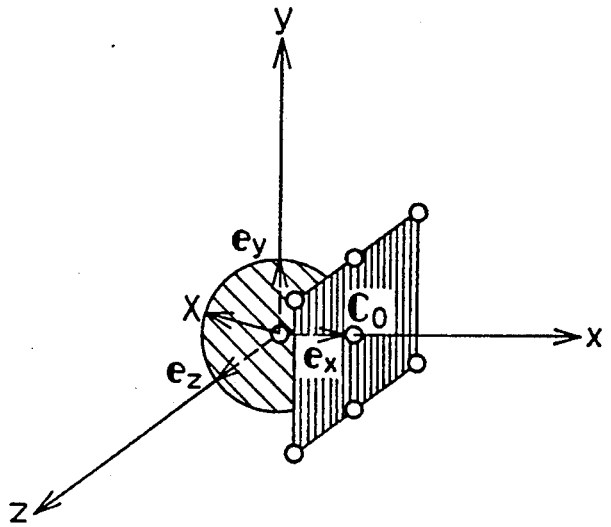
FIGS. 15A, 15B, and 15C are views for explaining the rearrangement of the vectors based on a modified second embodiment.
Figure 15B:
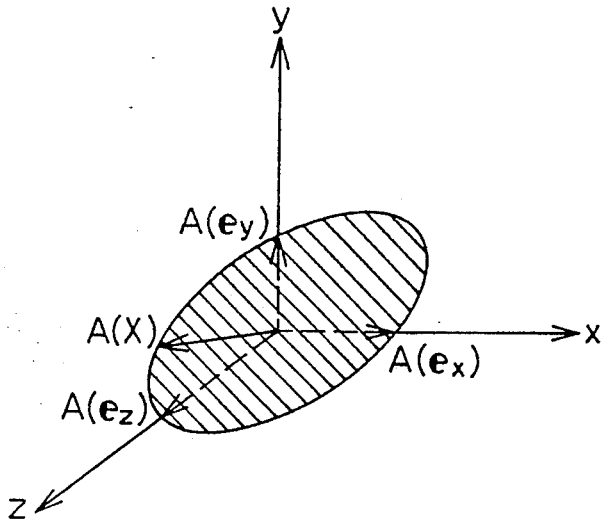
Figure 15C:
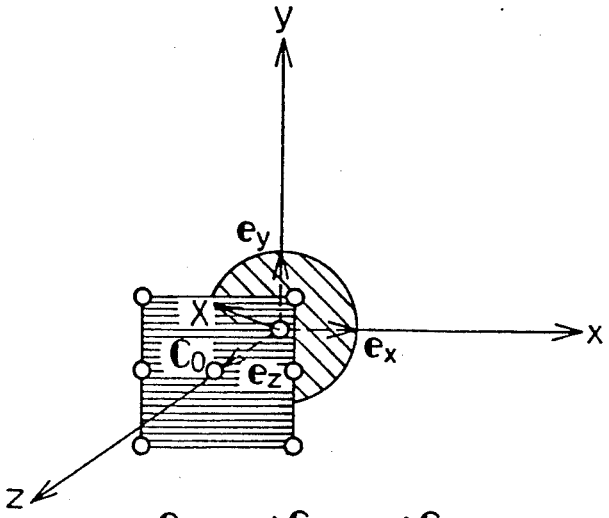

FIGS. 15A, 15B, and 15C are views for explaining the rearrangement of the vectors based on the modified second embodiment. In FIG. 15A, the ball around the origin of the coordinate system (hatched) is the space of all the vectors defined by the unit vectors $e_x$, $e_y$, and $e_z$. If provisionally the unit vector $e_x$ is allotted to the initial vector $C_0$ and the unit vectors $e_y$ and $e_z$ are allotted to the first delta vector $\Delta C_1$ and the second delta vector $\Delta C_2$, the planes defined by these become planes including the normal at the point $C_0$ on the ball. This corresponds to the mode A (FIG. 14A).

If linear prediction analysis filter (A) processing is applied to the vectors $C_0$ ($=e_x$), $\Delta C_1$ ($=e_y$), and $\Delta C_2$ ($=e_z$), usually the filter outputs A ($e_x$), A ($e_y$), and A ($e_z$) lose uniformity in the x-, y-, and z-axial directions and have a certain distortion. FIG. 15B shows this state. It shows the vector distribution in the case where the inequality shown at the bottom of the figure stands. That is, amplification is performed with a certain distortion by passing through the linear prediction analysis filter 3.

The properties A of the linear prediction analysis filter 3 show different amplitude amplification properties with respect to the vectors constituting the delta vector codebook 11, so it is better that all the vectors virtually created in the codebook 11 be distributed non-uniformly rather than uniformly through the vector space. Therefore, if it is investigated which direction of a vector component is amplified the most and the distribution of that direction of vector component is increased, it becomes possible to store the vectors efficiently in the codebook 11 and as a result the quantization characteristics of the speech signals become improved.

As mentioned earlier, there is a bias in the tree-structure distribution of delta vectors, but by rearranging the order of the delta vectors, the properties of the codebook 11 can be changed.

Referring to FIG. 15C, if there is a bias in the amplification factor of the power after filter processing as shown in FIG. 15B, the vectors are rearranged in order from the delta vector ($\Delta C_2$) with the largest power, then the codebook vectors are produced in accordance with the tree-structure array once more. By using such, a delta vector codebook 11 for coding, it is possible to improve the quality of the reproduced speech compared with the fixed allotment and arrangment of delta vectors as in the above-mentioned second embodiment.

Figure 16:
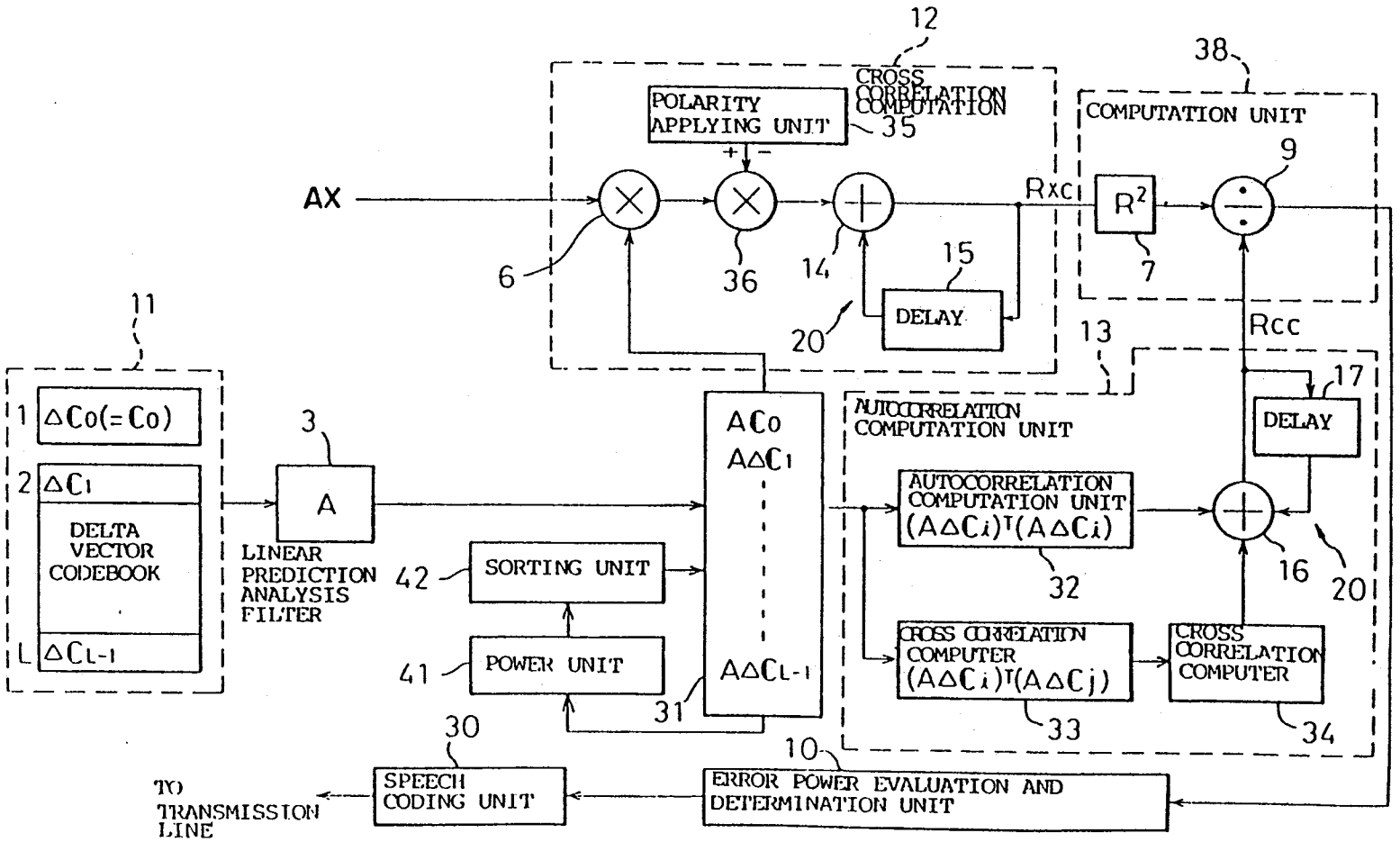
FIG. 16 is a view showing one example of the portion of the codebook retrieval processing based on the modified second embodiment.

FIG. 16 is a view showing one example of the portion of the codebook retrieval processing based on the modified second embodiment. It shows an example of the rearrangement shown in FIGS. 15A, 15B, and 15C. It corresponds to a modification of the structure of FIG. 12 (second embodiment) mentioned earlier. Compared with the structure of FIG. 12, in FIG. 16 the power evaluation unit 41 and the sorting unit 42 are cooperatively incorporated into the memory unit 31. The power evaluation unit 41 evaluates the power of the initial vector and the delta vectors after filter processing by the linear prediction analysis filter 3. Based on the magnitudes of the amplitude amplification factors of the vectors obtained as a result of the evaluation, the sorting unit 42 rearranges the order of the vectors. The power evaluation unit 41 and the sorting unit 42 may be explained as follows with reference to the above-mentioned FIGS. 14A to 14C and FIGS. 15A to 15C.

POWER EVALUATION UNIT 41

The powers of the vectors ($AC_0$, $A\Delta C_1$, and $A\Delta C_2$) obtained by linear prediction analysis filter processing of the vectors ($C_0$, $\Delta C_1$, and $\Delta C_2$) stored in the delta vector codebook 11 are calculated. At this time, as mentioned earlier, if the powers of the vectors are normalized (see following (1)), a direction comparison of the powers after filter processing would mean a comparison of the amplitude amplification factors of the vectors (see following (2)).

(1) Normalization of delta vectors: $e_x=C_0/|C_0|$, $e_y=\Delta C_1/|\Delta C_1|$, $e_z=\Delta C_2/|\Delta C_2|$, $|e_x|^2|e_y|^2=|e_z|^2$ (2) Amplitude amplification factor with respect to vector $C_0$: $|AC_0|^2/|C_0|^2=|Ae_x|^2$ Amplitude amplification factor with respect to vector $C_1$: $|AC_1|^2/|C_1|^2=|Ae_y|^2$ Amplitude amplification factor with respect to vector $C_2$: $|AC_2|^2/|C_2|^2=|Ae_z|^2$

SORTING UNIT 42

The amplitude amplification factors of the vectors by the analysis filter (A) are received from the power evaluation unit 41 and the vectors are rearranged (sorted) in the order of the largest amplification factors down. By this rearrangement, new delta vectors are set in the order of the largest amplification factors down, such as the initial vector ($C_0$), the first delta vector ($\Delta C_1$), the second delta vector ($\Delta C_2$) . . . . The following coding processing is performed in exactly the same way as the case of the tree-structure delta codebook of FIG. 12 using the tree-structure delta codebook 11 comprised by the obtained delta vectors. Below, the sorting processing in the case shown in FIGS. 15A to 15C will be shown.

(Sorting)

$|Ae_z|^2>|Ae_x|^2>|Ae_y|^2$ (Rearrangement)

$C_0=e_z$, $\Delta C_1=e_x$, $\Delta C_2=e_y$

The above-mentioned second embodiment and modified second embodiment, like in the case of the above-mentioned first embodiment, may be applied to any of the sequential optimization CELP type speech coder and simultaneous CELP type speech coder or pitch orthogonal transformation optimization CELP type speech coder etc. The method of application is the same as with the use of the cyclic adding means 20 (14, 15; 16, 17, 14-1, 15-1; 14-2, 15-2) explained in detail in the first embodiment.

Below, an explanation will be made of the various types of speech coders mentioned above for reference.

Figure 17:
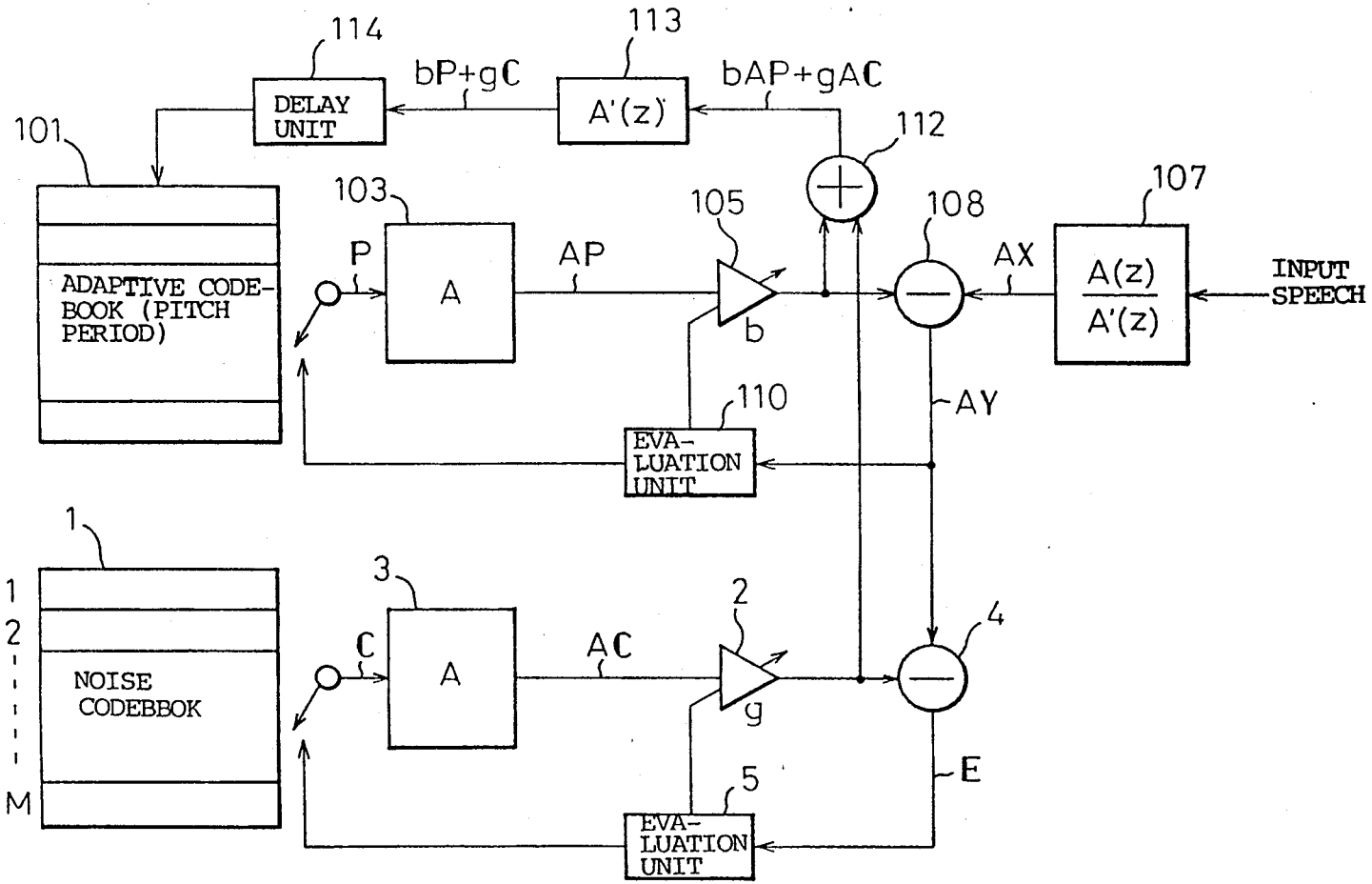
FIG. 17 is a view showing a coder of the sequential optimization CELP type.
Figure 18:
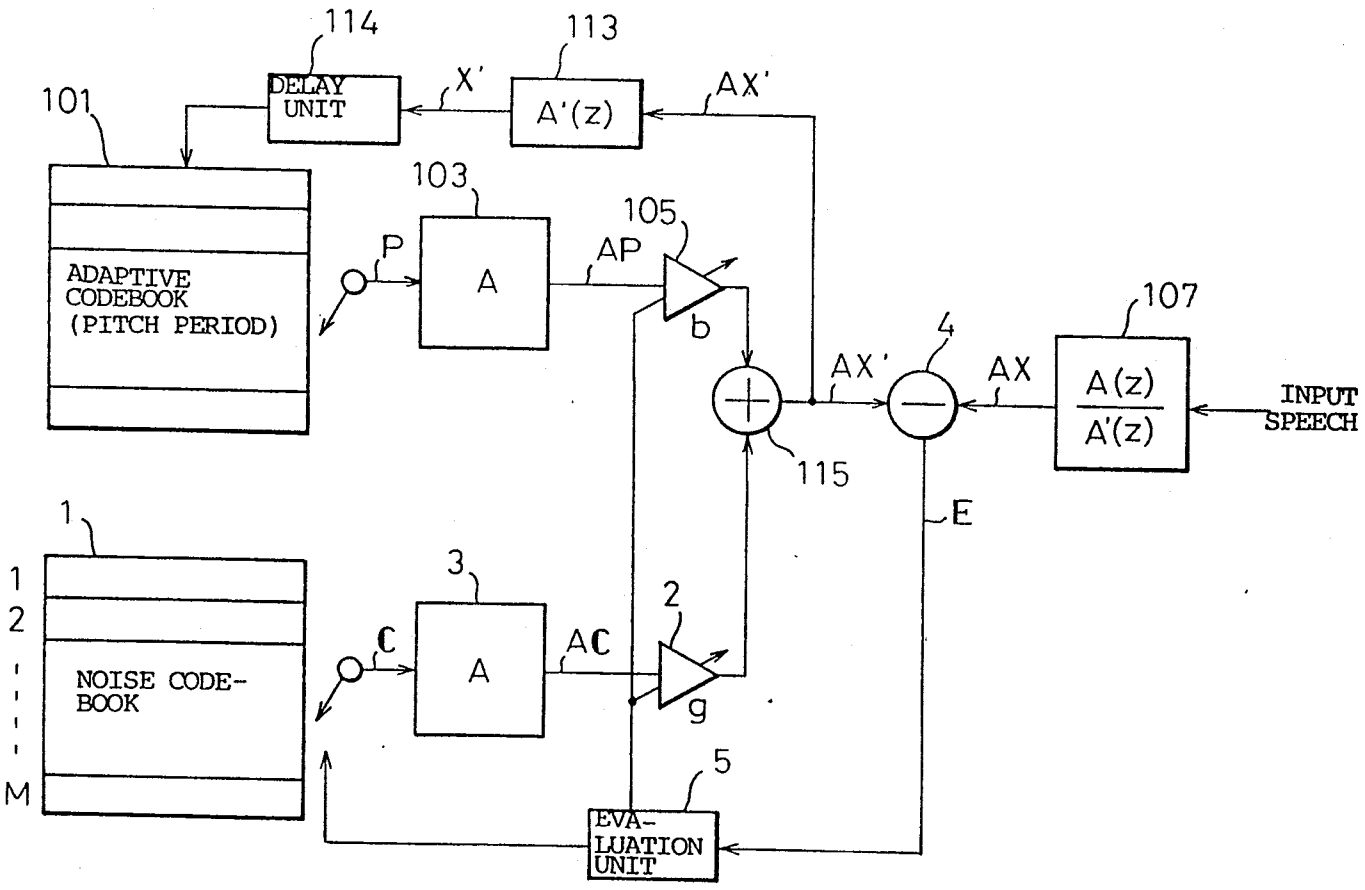
FIG. 18 is a view showing a coder of the simultaneous optimization CELP type.

FIG. 17 is a view showing a coder of the sequential optimization CELP type, and FIG. 18 is a view showing a coder of the simultaneous optimization CELP type. Note that constituent elements previously mentioned are given the same reference numerals or symbols.

In FIG. 17, the adaptive codebook 101 stores N dimensional pitch prediction residual vectors corresponding to the N samples delayed in pitch period one sample each. Further, the codebook 1 has set in it in advance, as mentioned earlier, exactly $2^m$ patterns of code vectors produced using the N dimensional noise trains corresponding to the N samples. Preferably, sample data with an amplitude less than a certain threshold (for example, N/4 samples out of N samples) out of the sample data of the code vectors are replaced by 0. Such a codebook is referred to as a sparsed codebook.

First, the pitch prediction vectors AP, produced by perceptual weighting by the perceptual weighting linear prediction analysis filter 103 shown by $A=1/A'(z)$ (where $A'(z)$ shows the perceptual weighting linear prediction analysis filter) of the pitch prediction differential vectors P of the adaptive codebook 101, are multiplied by the gain b by the amplifier 105 to produce the pitch prediction reproduced signal vectors bAP.

Next, the perceptually weighted pitch prediction error signal vectors AY between the pitch prediction reproduced signal vectors bAP and the input speech signal vector AX perceptually weighted by the perceptual weighting filter 107 shown by $A(z)/A'(z)$ (where $A'(z)$ shows a linear prediction analysis filter) are found by the subtraction unit 108. The optimal pitch predition differential vector P is selected and the optimal gain b is selected by the following equation $$|AY|^2=|AX-bAPX|^2 \tag{25}$$

by the evaluation unit 110 for each frame so as to give the minimum power of the pitch prediction error signal vector AY.

Further, as mentioned earlier, the perceptually weighted reproduced code vectors AC produced by perceptual weighting by the linear prediction analysis filter 3 in the same way as the code vectors C of the codebook 1 are multiplied with the gain g by the amplifier 2 so as to produce the linear prediction reproduced signal vectors gAC. Note that the amplifier 2 may be positioned before the filter 3 as well.

Further, the error signal vectors E of the linear prediction reproduced signal vectors gAC and the above-mentioned pitch prediction error signal vectors AY are found by the error generation or subtraction unit 4 and the optimal code vector C is selected from the codebook 1 and the optimal gain g is selected with each frame by the evaluation unit 5 so as to give the minimum power of the error signal vector E by the following:

$$|E|^2=|AY-gAC|^2 \tag{26}$$

Note that the adaptation of the adaptive codebook 101 is performed by finding bAP+gAC by the adding unit 112, analyzing this to bP+gC by the perceptual weighting linear prediction analysis filter ($A'(z)$) 113, giving a delay of one frame by the delay unit 114, and storing the result as the adaptive codebook (pitch prediction codebook) of the next frame.

In this way, in the sequential optimization CELP type coder shown in FIG. 17, the gains b and g are separately controlled, while in the simultaneous optimization CELP type coder shown in FIG. 18, the bAP and gAC are added by the adding unit 115 to find AX'=bAP+gAC, further, the error signal vector E with the perceptually weighted input speech signal vector AX from the filter 107 is found in the above way by the error generating unit 4, the code vector C giving the minimum power of the vector E is selected by the evaluation unit 5 from the codebook 1, and the optimal gains b and g are simultaneously controlled to be selected.

In this case, from the above-mentioned equations (25) and (26), the following is obtained:

$$\|E\|^2=\|AX-bAP-gAC\|^2 \quad (27)$$

Note that the adaptation of the adaptive codebook 101 in this case is performed in the same way with respect to the AX' corresponding to the output of the adding unit 112 of FIG. 17.

Figure 19:
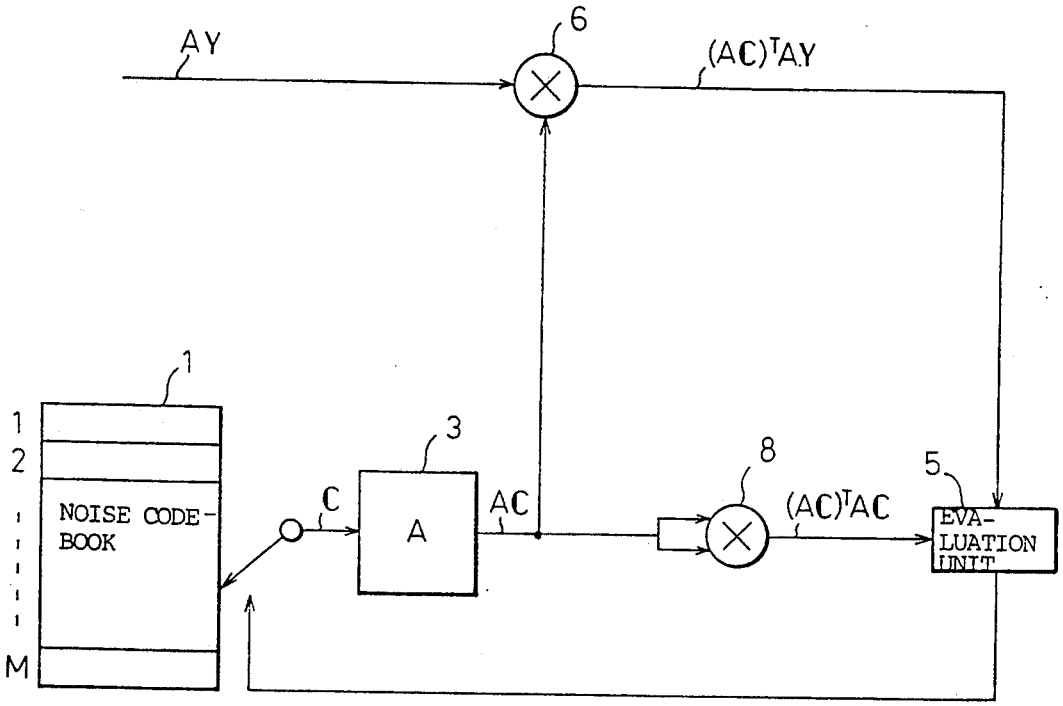
FIG. 19 is a view showing the sequential optimization process in FIG. 17.
Figure 20:
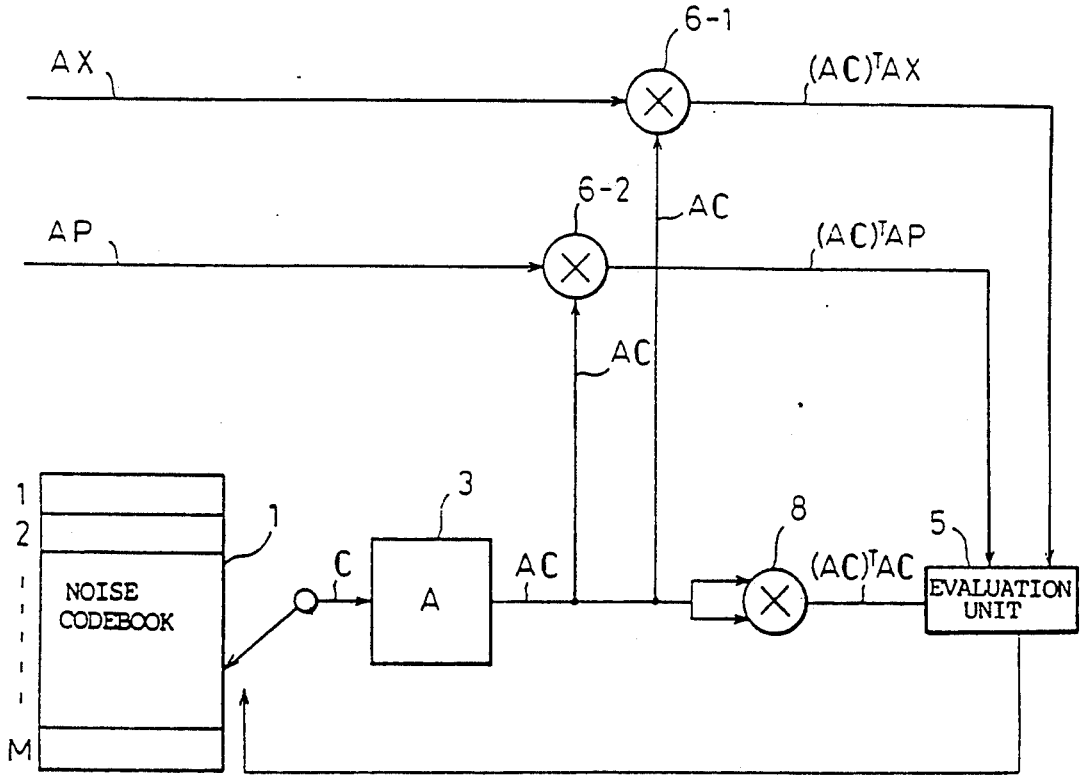
FIG. 20 is a view showing the simultaneous optimization process in FIG. 18.

The gains b and g shown in the above FIG. 17 and FIG. 18 actually perform the optimization for the code vector C of the codebook 1 in the respective CELP systems as shown in FIG. 19 and FIG. 20.

That is, in the case of FIG. 17, in the above-mentioned equation (26), if the gain g for giving the minimum power of the vector E is found by partial differentiation, then from $$\begin{aligned} 0 &= \delta(\|AY-gAC\|^2)/\delta g \\ &= 2(-AC)^T(AY-gAC) \end{aligned}$$

the following is obtained:

$$g=(AC)^TAY/(AC)^TAC \quad (28)$$

Therefore, in FIG. 19, the pitch prediction error signal vector AY and the code vectors AC obtained by passing the code vectors C of the codebook 1 through the perceptual weighting linear prediction analysis filter 3 and are multiplied by the multiplying unit 6 to produce the correlation value $(AC)^TAY$. In addition the auto correlation value $(AC)^TAC$ of the perceptually weighted reproduced code vectors AC is found by the auto correlation computation unit 8.

Further, the evaluation unit 5 selects the optimal code vector C and gain g giving the minimum power of the error signal vectors E with respect to the pitch prediction error signal vectors AY by the above-mentioned equation (28) based on the two correlation values $(AC)^TAY$ and $(AC)^TAC$.

Note that the gain g is found with respect to the code vectors C so as to minimize the above-mentioned equation (26). If the quantization of the gain is performed by an open loop mode, this is the same as maximizing the following equation:

$$((AY)^TAC)^2/(AC)^TAC$$

Further, in the case of FIG. 18, in the above-mentioned equation (27), if the gains b and g for minimizing the power of the vectors E are found by partial differentiation, then $$g=[(AP)^TAP(AC)^TAX-(AC)^TAP(AP)^TAX]/\nabla$$

$$b=[(AC)^TAC(AP)^TAX-(AP)^TAP(AP)^TAX]/\nabla \quad (29)$$

where, $$\nabla=(AP)^TAP(AC)^TAC-((AC)^TAP)^2$$

Therefore, in FIG. 20, the perceptually weighted input speech signal vector AX and the code vectors AC obtained by passing the code vectors C of the codebook 1 through the perceptual weighting linear prediction analysis filter 3 are multiplied by the multiplying unit 6-1 to produce the correlation values $(AC)^TAX$ of the two, the perceptually weighted pitch prediction vectors AP and the code vectors AC are multiplied by the multiplying unit 6-2 to produce the cross correlations $(AC)^TAP$ of the two, and the auto correlation values $(AC)^TAC$ of the code vectors AC are found by the auto correlation computation unit 8.

Further, the evaluation unit 5 selects the optimal code vector C and gains b and g giving the minimum power of the error signal vectors E with respect to the perceptually weighted input speech signal vectors AX by the above-mentioned equation (29) based on the correlation values $(AC)^TAX$, $(AC)^TAP$, and $(AC)^TAC$.

In this case too, minimizing the power of the vector E is equivalent to maximizing the ratio of the correlation value $$2b(AP)^TAX-b^2(AP)^TAP+2g(AC)^TAX-g^2(AC)^TAC-2bg(AP)^TAC$$

In this way, in the case of the sequential optimization CELP system, less of an overall amount of computation is needed compared with the simultaneous optimization CELP system, but the quality of the coded speech is deteriorated.

Figure 21A:
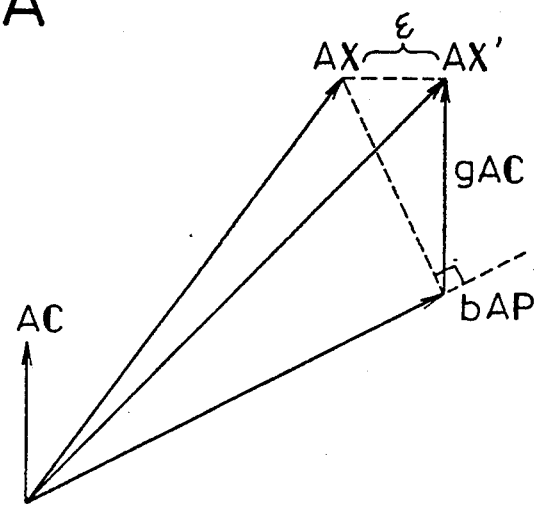
FIG. 21A is a vector diagram showing schematically the gain optimization operation in the case of the sequential optimization CELP system.
Figure 21B:
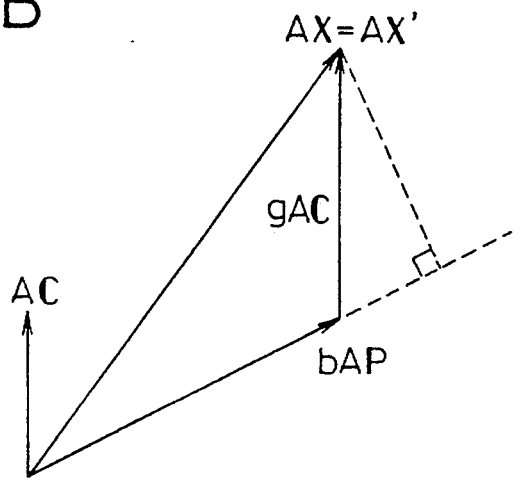
FIG. 21B is a vector diagram showing schematically the gain optimization operation in the case of the simultaneous CELP system.
Figure 21C:
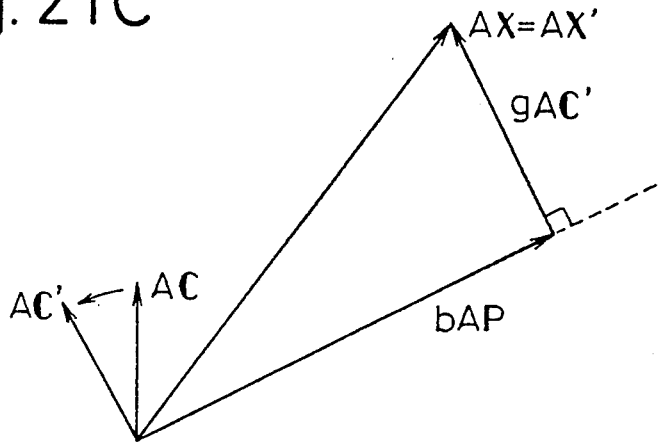
FIG. 21C is a vector diagram showing schematically the gain optimization operation in the case of the pitch orthogonal transformation optimization CELP system.

FIG. 21A is a vector diagram showing schematically the gain optimization operation in the case of the sequential optimization CELP system, FIG. 21B is a vector diagram showing schematically the gain optimization operation in the case of the simultaneous CELP system, and FIG. 21C is a vector diagram showing schematically the gain optimization operation in the case of the pitch orthogonal tranformation optimization CELP system.

In the case of the sequential optimization system of FIG. 21A, a relatively small amount of computation is required for obtaining the optimized vector AX'=bAP+gAC, but error easily occurs between the vector AX' and the input vector AX' so the quality of the reproduction of the signal becomes poorer.

Further, the simultaneous optimization system of FIG. 21B becomes AX'=AX as illustrated in the case of two dimensions, so in general the simultaneous optimization system gives a better quality of reproduction of the speech compared with the sequential optimization system, but as shown in equation (29), there is the problem that the amount of computation becomes greater.

Figure 22:
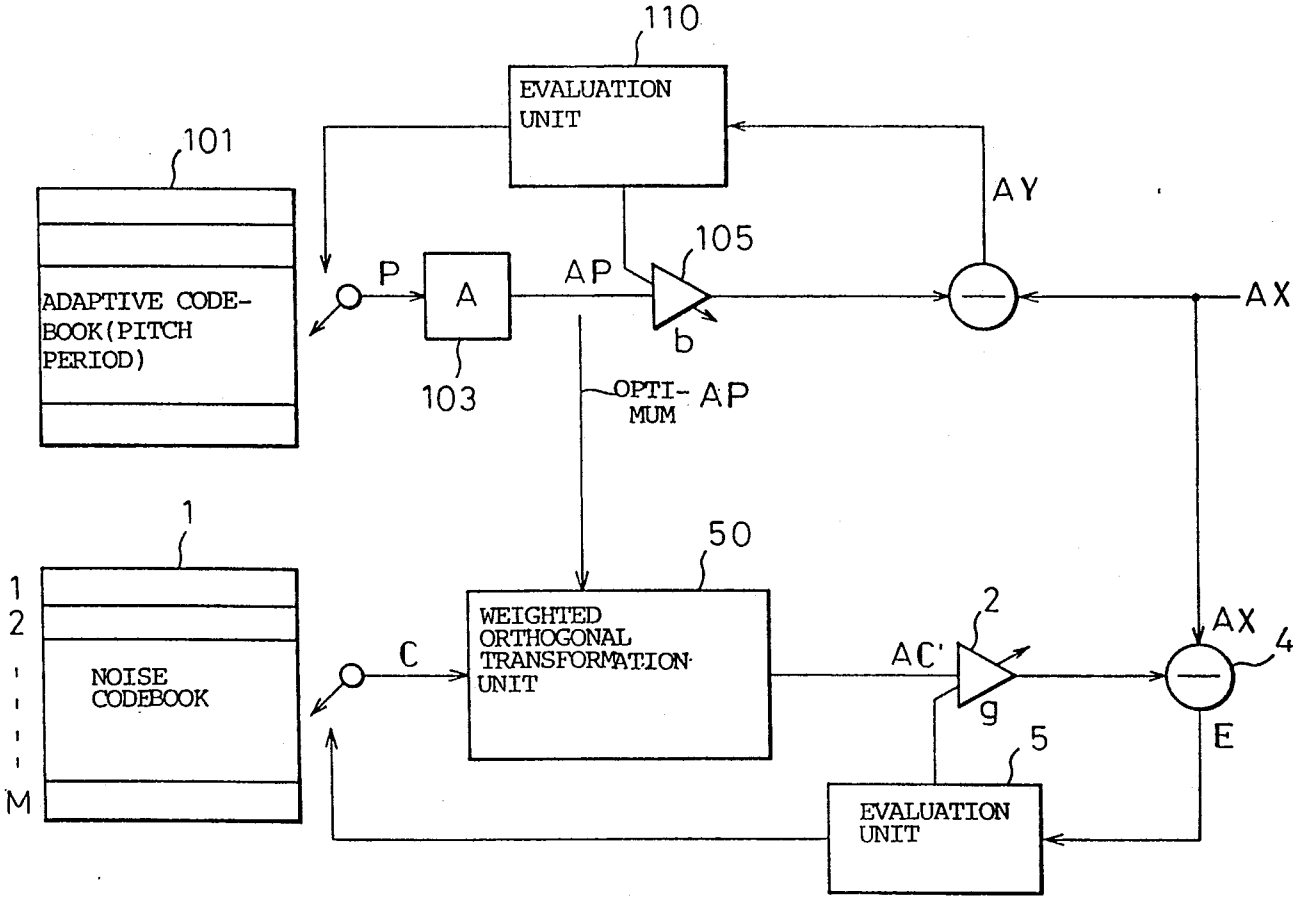
FIG. 22 is a view showing a coder of the pitch orthogonal transformation optimization CELP type.

Therefore, the present assignee previously filed a patent application (Japanese Patent Application No. 2-161041) for the coder shown in FIG. 22 for realizing satisfactory coding and decoding in terms of both the quality of reproduction of the speech and amount of computation making use of the advantages of each of the sequential optimization/simultaneous optimization type speech coding systems.

That is, regarding the pitch period, the pitch prediction differential vector P and the gain b are evaluated and selected in the same way as in the past, but regarding the code vector C and the gain g, the weighted orthogonal transformation unit 50 is provided and the code vectors C of the codebook 1 are transformed into the perceptually weighted reproduced C code vectors AC' orthogonal to the optimal pitch prediction differential vector AP in the perceptually weighted pitch prediction differential vectors.

Explaining this further by FIG. 21C, in consideration of the fact that the failure of the code vector AC taken out of the codebook 1 and subjected to the perceptual weighting matrix A to be orthogonal to the perceptually weighted pitch prediction reproduced vector bAP as mentioned above is a cause for the increase of the quantization error $\epsilon$ in the sequential quantization system as shown in FIG. 21A, it is possible to reduce the quantization error to about the same extent as in the simultaneous optimization system even in the sequential optimization CELP system of FIG. 21A if the perceptually weighted code vector AC is orthogonally transformed by a known technique to the code vector AC' orthogonal to the perceptually weighted pitch prediction differential vector AP.

The thus obtained code vector AC' is multiplied with the gain g to produce the linear prediction reproduced signal gAC', the code vector giving the minimum linear prediction error signal vector E from the linear prediction reproduced signals gAC' and the perceptually weighted input speech signal vector AX is selected by the evaluation unit 5 from the codebook 1, and the gain g is selected.

Note that to slash the amount of filter computation in retrieval of the codebook, it is desirable to use a sparsed noise codebook where the codebook is comprised of noise trains of white noise and a large number of zeros are inserted as sample values. In addition, use may be made of an overlapping codebook etc. where the code vectors overlap with each other.

Figure 23:
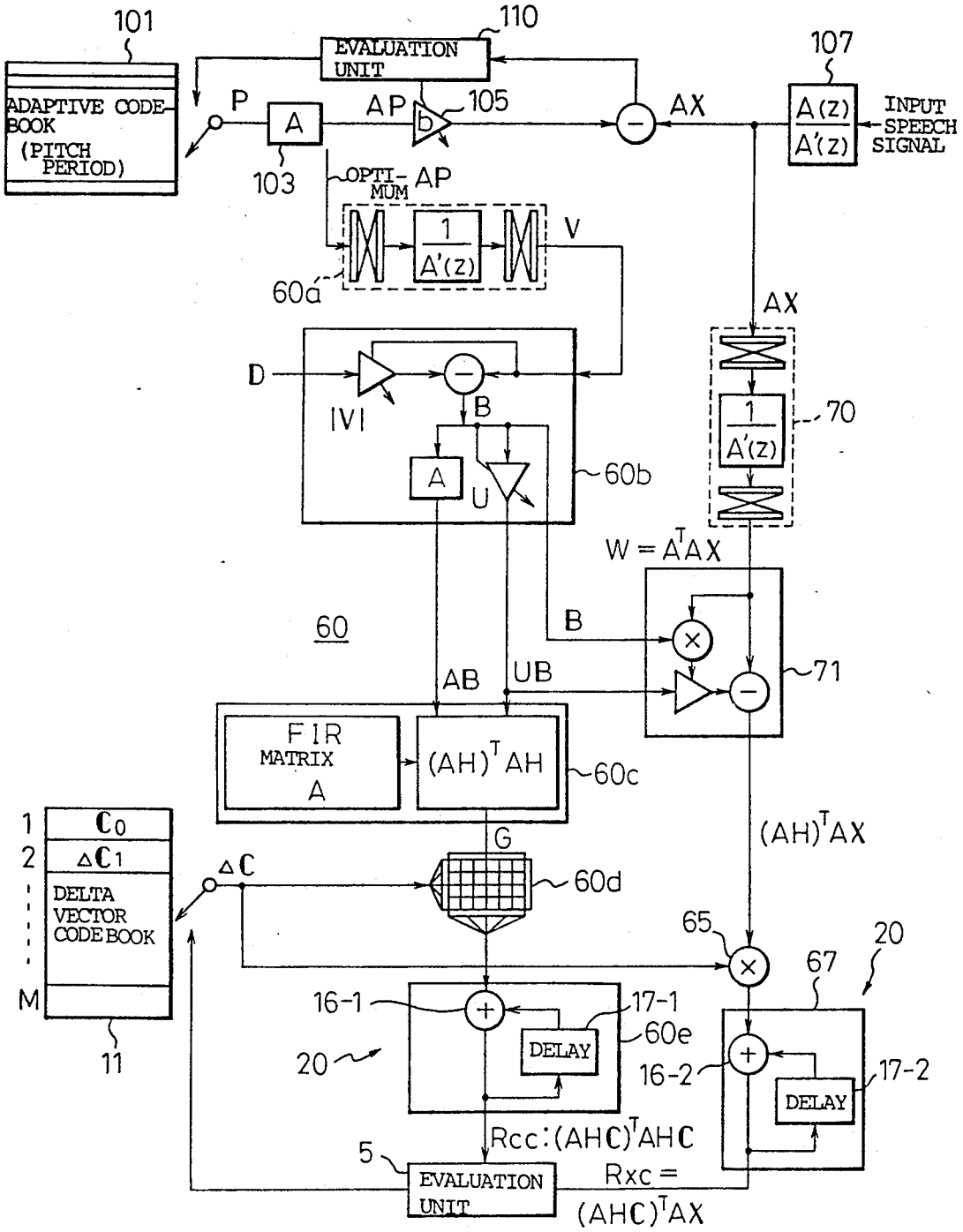
FIG. 23 is a view showing in more detail the portion of the codebook retrieval processing under the first embodiment using still another example.

FIG. 23 is a view showing in more detail the portion of the codebook retrieval processing under the first embodiment using still another example. It shows the case of application to the above-mentioned pitch orthogonal transformation optimization CELP type speech coder. In this case too, the present invention may be applied without any obstacle.

This FIG. 23 shows an example of the combination of the auto correlation computation unit 13 of FIG. 10 with the structure shown in FIG. 9. Further, the computing means 19' shown in FIG. 9 may be constructed by the transposed matrix $A^T$ in the same way as the computing means 19 of FIG. 6, but in this example is constructed by a time-reverse type filter.

The auto correlation computing means 60 of the figure is comprised of the computation units 60*a* to 60*e*. The computation unit 60*a*, in the same way as the computing means 19', subjects the optimal perceptually weighted pitch prediction differential vector AP, that is, the input signal, to time-reversing perceptual weighting to produce the computed auxiliary vector $V=A^TAP$.

This vector V is transformed into three vectors B, uB, and AB in the computation unit 60*b* which receives as input the vectors D orthogonal to all the delta vectors $\Delta C$ in the delta vector codebook 11 and applies perceptual weighting filter (A) processing to the same.

The vectors B and uB among these are sent to the time-reversing orthogonal transformation unit 71 where time-reversing householder orthogonal transformation is applied to the $A^TAX$ output from the computing means 70 so as to produce $H^TA^TAX=(AH)^TAX$.

Here, an explanation will be made of the time-reversing householder transformation $H^T$ in the transformation unit 71.

Figure 24A:
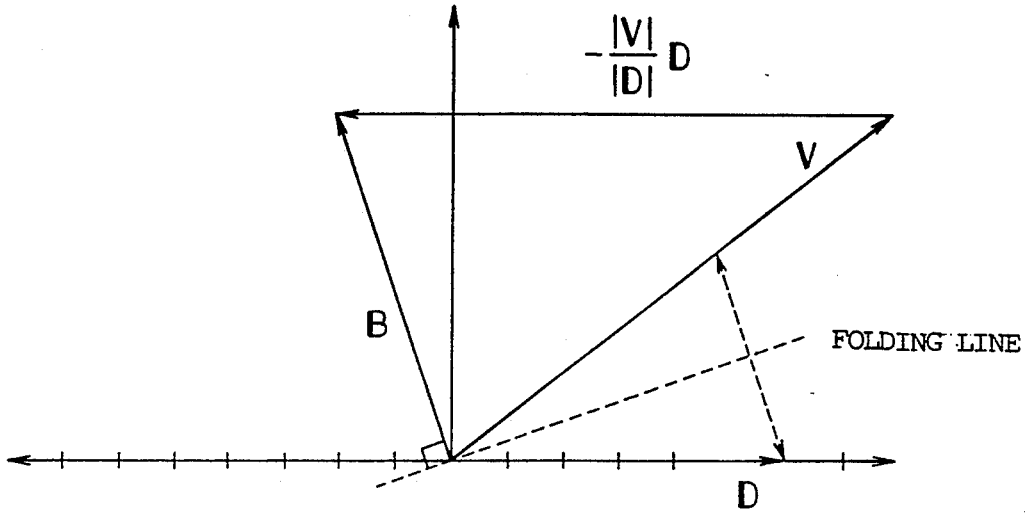
FIG. 24A and FIG. 24B are vector diagrams for explaining the householder orthogonal transformation.
Figure 24B:
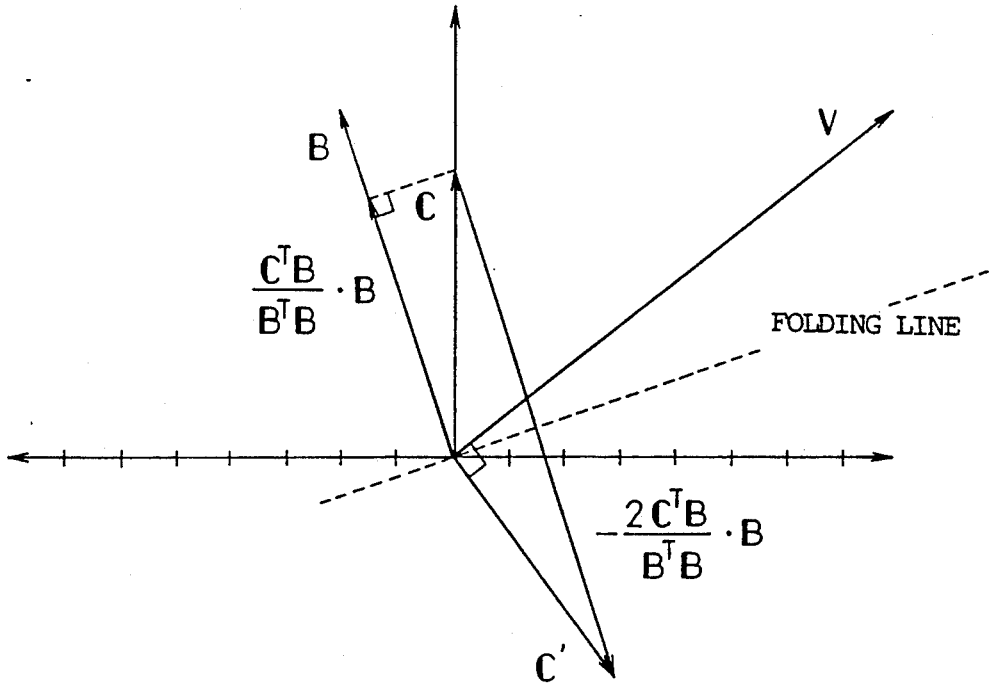

First, explaining the householder transformation itself using FIG. 24A and FIG. 24B, when the computed auxiliary vector V is folded back at a parallel component of the vector D using the folding line shown by the dotted line, the vector $(|V|/|D|)D$ is obtained. Note that $D/|D|$ indicates the un in the D direction.

The thus obtained D direction vector is taken as $1(|V|/|D|)D$ in the $-D$ direction, that is, the opposite direction, as illustrated. As a result, the vector $B=V-(|V|/|D|)D$ obtained by addition with V becomes orthogonal with the folding line (see FIG. 24B).

Next, if the component of the vector C in the vector B is found, in the same way as in the case of FIG. 24A, the vector $\{(C^TB)/(B^TB)\}B$ is obtained.

If double the vector in the direction opposite to this vector is taken and added to the vector C, then a vector C' orthogonal to V is obtained. That is, $$C'=C-2B\{(C^TB)/(B^TB)\}B \quad (30).$$

In this equation (30), if $u=2/B^TB$, then $$C'=C-B(uB^TC) \quad (31)$$

On the other hand, since $C'=HC$, equation (31) becomes $$H=C'C^{-1}=I-B(uB^T) \text{ (wherein I is a unit vector)}$$

Therefore, $$H^T=I-(uB)B^T=I-B(uB^T)$$

This is the same as H.

Therefore, if the input vector $A^TAX$ of the transformation unit 71 is made, for example, W, then $$H^TW=W-(WB)(uB^T)=(AH)^TAX$$

and the computation becomes as illustrated in structure. Note that in the figure, the portions indicated by the circle marks or data express vector computations, while the portions indicated by the triangle marks express scalar computations.

As the method of orthogonal transformation, there is also known the Gram-Schmidt method etc.

Further, if the delta vectors $\Delta C$ from the codebook 11 are multiplied with the vector $(AH)^TAX$ at the multiplying unit 65, then the correlation values $$R_{XC}=(\Delta C)^T(AH)^TAX=(AH\Delta C)^TAX$$

are obtained. This is cyclically added by the cyclic adding unit 67 (cyclic adding means 20), whereby $(AHC)^TAX$ is sent to the evaluation unit 5.

As opposed to this, at the computation unit 60*c*, the orthogonal transformation matrix H and the time-reversing orthogonal transformation matrix $H^T$ are found from the input vectors AB and uB. Further, a finite impulse response (FIR) perceptual weighting filter matrix A is incorporated to this to produce, for each frame, the auto correlation matrix $G=(AH)^TAH$ of the time-reversing perceptually weighting orthogonal transformation matrix AH by the computing means 70 and the transforming means 71.

Further, the thus found auto correlation, matrix $G=(AH)^TAH$ is stored in the computation unit 60*d* in FIG. 23 and is also shown in FIG. 10. When the delta vectors $\Delta C$ are given to the computation unit 60*d* from the codebook 11, $$(\Delta C_i)^TGC_{i-1}+(\Delta C_i)^TG\Delta C_i$$

is obtained. This is cyclically added with the previous auto correlation value $(AHC_{i-1})^TAHC_{i-1}$ at the cyclic adding unit 60e (cyclic computing unit 20), thereby enabling the present auto correlation value of $(AHC_i)^T AHC_i$ to be found and sent to the evaluation unit 5.

In this way, it is possible to select the optimal delta vector and gain based on the two correlation values sent to the evaluation unit 5.

Finally, an explanation will be made of the benefits to be obtained by the first embodiment and the second embodiment of the present invention using numerical examples.

FIG. 25 is a view showing the ability to reduce the amount of computation by the first embodiment of the present invention. Section (a) of the figure shows the case of a sequential optimization CELP type coder and shows the amount of computation in the cases of use of (1) a conventional 4/5 sparsed codebook.
(2) a conventional overlapping codebook, and
(3) a delta vector codebook based on the first embodiment of the present invention as the noise codebook.

N in FIG. 25 is the number of samples, and $N_P$ is the number of orders of the filter 3. Further, there are various scopes for calculating the amount of computation, but here the scope is shown of just the (1) filter processing computation, (2) cross correlation computation, and (3) auto correlation computation, which require extremely massive computations in the coder.

Specifically, if the number of samples N is 10, then as shown at the right end or side of the figure, the total amount of computations becomes 432K multiplication and accumulation operations in the conventional example (1) and 84K multiplication and accumulation operations in the conventional example (2). As opposed to this, according the first embodiment, 28K multiplication and accumulation operations are required, for a major reduction in the auto/correlation computation of (3).

Section (b) and section (c) of FIG. 25 show the case of a simultaneous optimization CELP type coder and a pitch orthogonal transformation optimization CELP type coder. The amounts of computation are calculated for the cases of the three types of codebooks just as in the case of section (a). In either of the cases, in the case of application of the first embodiment of the present invention, the amount of computation can be reduced tremendously to 30K multiplication and accumulation operations or 28K multiplication and accumulation operations, it is learned.

FIG. 26 is a view showing the ability to reduce the amount of computation and to slash the memory size by the second embodiment of the present invention. Section (a) of the figure shows the amount of computations and section (b) the size of the memory of the codebook.

The number of samples N of the code vectors is made a standard N of 40. Further, as the size M of the codebook, the standard M of 1024 is used in the conventional system, but the size M of the second embodiment of the present invention is reduced to L, specifically with L being made 10. This L is the same as the number of layers 1, 2, 3 . . . L shown at the top of FIG. 11.

Whatever the case, seen by the total of the amount of computations, the 480K multiplication and accumulation operations (96 $M_{ops}$) required in the conventional system are slashed to about 1/70th that amount, of 6.6K multiplication and accumulation operations, in the second embodiment of the present invention.

Further, a look at the size of the memory (section (b)) in FIG. 26 shows it reduced to 1/100th the previous size.

Even in the modified second embodiment, the total amount of the computations, including the filter processing computation, accounting for the majority of the computations, the computation of the auto correlations, and the computation of the cross correlations, is slashed in the same way as the value shown in FIG. 26.

In this way, according to the first embodiment of the present invention, use is made of the difference vectors (delta vectors) between adjoining code vectors as the code vectors to be stored in the noise codebook. As a result, the amount of computation is further reduced from that of the past.

Further, in the second embodiment of the present invention, further improvements are made to the above-mentioned first embodiment, that is:

(i) The $N_P \cdot N \cdot M$ ($=1024 \cdot N_P \cdot N$) number of multiplication and accumulation operations required in the past for filter processing can be reduced to $N \cdot N \cdot L$ ($=10 \cdot N_P \cdot N$) number of multiplication and accumulation operations.

(ii) It is possible to easily find the code vector giving the minimum error power.

(iii) The $M \cdot N$ ($=1024 \cdot N$) number of multiplication and accumulation operations required in the past for computation of the cross correlation can be reduced to $L \cdot N$ ($=10 \cdot N$) number of multiplication and accumulation operations, so the number of computations can be tremendously reduced.

(iv) The $M \cdot N$ ($=1024 \cdot N$) number of multiplication and accumulation operations required in the past for computation of the auto correlation can be reduced to $L(L+1) \cdot N/2 (=55 \cdot N)$ number of multiplication and accumulation operations.

(v) The size of the memory can be tremendously reduced.

Further, according to the modified second embodiment, it is possible to further improve the quality of the reproduced speech.

We claim:

1. A speech coding system coding input speech by evaluation computation producing a single code vector providing a minimum error between an input speech signal and reproduced signals generated by a linear prediction analysis filter, the linear prediction analysis filter using code vectors successively read from a noise codebook storing a plurality of noise trains as the code vectors and a code specifying the single code vector, said speech coding system comprising:

said noise codebook, connected to the linear prediction analysis filter and including a delta vector codebook storing an initial vector and a plurality of delta vectors produced using differential vectors determined between adjoining code vectors for all of the code vectors, and said plurality of delta vectors being cyclically added to reproduce the code vectors.

2. A speech coding system as set forth in claim 1, wherein said plurality of delta vectors comprise N dimensional vectors each comprised of N number (N being a natural number of at least 2) of time-series sample data, and several of the N number of time-series sample data are significant data, and others of the N number of time-series sample data are sparsed vectors comprised of data 0.

3. A speech coding system coding input speech by evaluation computation producing a single code vector providing a minimum error between an input speech signal and reproduced signals generated by a linear prediction analysis filter, the linear prediction analysis filter using code vectors successively read from a noise codebook storing a plurality of noise trains as the code vectors and a code specifying the single code vector, said speech coding system comprising:

said noise codebook, connected to the linear prediction analysis filter and including a delta vector codebook storing an initial vector and a plurality of delta vectors produced using differential vectors determined between adjoining code vectors for all of the code vectors, and said plurality of delta vectors being cyclically added to reproduce the code vectors, wherein said plurality of delta vectors comprise N dimensional vectors each comprised of N number (N being a natural number of at least 2) of time-series sample data, and several of the N number of time-series sample data are significant data, and others of the N number of time-series sample data are sparsed vectors comprised of data 0, and wherein the code vectors in the noise codebook are rearranged as rearranged code vectors so that the differential vectors determined between the adjoining code vectors become smaller, and wherein the differential vectors between the adjoining code vectors are determined for the rearranged code vectors, and the sparsed vectors are obtained using the differential vectors.

4. A speech coding system coding input speech by evaluation computation producing a single code vector providing a minimum error between an input speech signal and reproduced signals generated by a linear prediction analysis filter, the linear prediction analysis filter using code vectors successively read from a noise codebook storing a plurality of noise trains as the code vectors and a code specifying the single code vector, said speech coding system comprising:

said noise codebook, connected to the linear prediction analysis filter and including a delta vector codebook storing an initial vector and a plurality of delta vectors produced using differential vectors determined between adjoining code vectors for all of the code vectors, and said plurality of delta vectors being cyclically added to reproduce the code vectors; and computing means for performing the evaluation computation, and said computing means including cyclic adding means for performing cyclic addition on said plurality of delta vectors.

5. A speech coding system as set forth in claim 4, wherein said cyclic adding means comprises:

adding unit means having inputs for adding the plurality of delta vectors and outputting an add signal; and delay unit means for delaying the add signal output from the adding unit means and outputting a delayed signal being input to one of the inputs of the adding unit means, and wherein previous computation results are held in said delay unit means and a next delta vector is used as the input to said adding unit means, and the evaluation computation is cumulatively updated.

6. A speech coding system coding input speech by evaluation computation producing a single code vector providing a minimum error between an input speech signal and reproduced signals generated by a linear prediction analysis filter, the linear prediction analysis filter using code vectors successively read from a noise codebook storing a plurality of noise trains as the code vectors and a code specifying the single code vector, said speech coding system comprising:

said noise codebook, connected to the linear prediction analysis filter and including a delta vector codebook storing an initial vector and a plurality of delta vectors produced using differential vectors determined between adjoining code vectors for all of the code vectors, and said plurality of delta vectors being cyclically added to reproduce the code vectors, wherein the plurality of delta vectors include (L−1) types of delta vectors arranged in a tree-structure having a peak, where L is a total number of layers comprising the tree-structure with the initial vector located at the peak.

7. A speech coding system as set forth in claim 6, wherein the (L−1) types of delta vectors are one of successively added to and successively subtracted from the initial vector for each of the layers to virtually reproduce $(2^L-1)$ types of code vectors.

8. A speech coding system as set forth in claim 7, wherein the code vectors include $2^L$ types of code vectors, and wherein zero vectors are added to the $(2^L-1)$ types of code vectors to reproduce $2^L$ types of reproduced code vectors of the same number as the $2^L$ types of code vectors stored in said noise codebook.

9. A speech coding system as set forth in claim 7, wherein the code vectors include $2^L$ types of code vectors, and wherein one of the code vectors generated by multiplying the initial vector by −1 is added to the $(2^L-1)$ types of code vectors to reproduce the $2^L$ types of reproduced code vectors of the same number as the $2^L$ types of code vectors stored in said noise codebook.

10. A speech coding system as set forth in claim 6, further comprising computing means for performing the evaluation computation, and said computing means including cyclic adding means for performing cyclic addition on said plurality of delta vectors.

11. A speech coding system as set forth in claim 10, wherein said evaluation computation performed by said computing means includes a cross correlation computation of a cross correlation and a linear prediction analysis filter computation of an analysis filter computation output comprised of a first recurrence equation using a previous analysis filter computation output from a previous layer and one of the plurality of delta vectors, whereby the cross correlation computation is performed using a second recurrence equation.

12. A speech coding system as set forth in claim 11, wherein said evaluation computation performed by said computing means includes an auto correlation computation of an auto correlation, and wherein the analysis filter computation output is comprised of the first recurrence equation using the previous analysis filter computation output from the previous layer and the one of the plurality of delta vectors, whereby the auto correlation computation is performed using an L number of auto correlations of the analysis filter computation output computed from the initial vector, a filter computation output of the (L−1) types of delta vectors and $(L^2-1)/2$ types of cross correlations using the analysis filter computation output.

13. A speech coding system as set forth in claim 6, wherein an order of the initial vector and said $(L-1)$ types of delta vectors in the tree-structured is rearranged responsive to properties of the input speech.

14. A speech coding system as set forth in claim 13, wherein the initial vector and the $(L-1)$ types of delta vectors are stored and rearranged in frames responsive to filter properties of the linear prediction analysis filter performing the linear prediction analysis filter computation, and one of the evaluation computations.

15. A speech coding system as set forth in claim 14, wherein a first power of each of said reproduced signals generated by the linear prediction analysis filter is evaluated by said evaluation computation and the code vectors are rearranged in a new order successively from one of the code vectors corresponding to one of the reproduced signals with the first power most increased compared with a second power of the one of the code vectors determined before the reproduced signals are generated.

16. A speech coding system as set forth in claim 15, wherein said initial vector and the $(L-1)$ delta vectors are transformed in advance to be mutually orthogonal with each other after the filter processing, and the initial vector and the plurality of delta vectors in the delta vector codebook are uniformly distributed on a hyper plane.

17. A speech coding system as set forth in claim 15, wherein a magnitude of the first power is compared with a normalized power obtained by normalization of each first power.

18. A speech coding system as set forth in claim 13, wherein said code specifying the single code vector is specified so that a first intercode distance belonging to higher layers in the tree-structure becomes greater than a second intercode distance belonging to lower layers.

19. A noise codebook storing noise trains as code vectors in a speech coding system, comprising:

a delta vector codebook storing an initial vector and delta vectors produced from differences determined between the code vectors, and said initial and delta vectors being used to reproduce the code vectors.

20. A noise codebook storing noise trains as code vectors in a speech coding system, comprising:

a delta vector codebook storing an initial vector and delta vectors produced from differences determined between the code vectors, and said initial and delta vectors being used to reproduce the code vectors, wherein the code vectors $C_i$, i being a first integer between 0 and $(m-1)$, and m being a second integer representing a number of the noise trains stored in the noise codebook, are generated using said delta vectors $\Delta C_i$ according to:

$$C_0 = C_0$$
$$C_1 = C_0 + \Delta C_1$$
$$C_2 = C_1 + \Delta C_2$$
$$\vdots$$
$$C_{m-1} = C_{m-2} + \Delta C_{m-1}.$$

21. A noise codebook storing noise trains as code vectors in a speech coding system, comprising:

a delta vector codebook storing an initial vector and delta vectors produced from differences determined between the code vectors, and said initial and delta vectors being used to reproduce the code vectors, wherein the code vectors are generated by computing and cyclically adding the delta vectors.

22. A noise codebook storing noise trains as code vectors in a speech coding system, comprising:

a delta vector codebook storing an initial vector and delta vectors produced from differences determined between the code vectors, and said initial and delta vectors being used to reproduce the code vectors, wherein a linear production analysis filter is used to compute powers of said initial and delta vectors, and wherein said initial and delta vectors are stored in an order in said delta vector codebook based on said powers.

23. A noise codebook storing noise trains as code vectors in a speech coding system, comprising:

a delta vector codebook storing an initial vector and delta vectors produced from differences determined between the code vectors, and said initial and delta vectors being used to reproduce the code vectors, wherein said delta vector codebook stores said initial vector and $(L-1)$ types of said delta vectors based on a tree-structure having stages, L being a first number of said stages in said tree-structure.

24. A noise codebook as set forth in claim 23, wherein the code vectors $C_i$, i being a first integer between 0 and $(m-1)$, and m being a second integer representing a second number of the noise trains stored in the noise codebook, are generated using said delta vectors $\Delta C_i$ according to:

$$C_0 = C_0$$
$$C_1 = C_0 + \Delta C_1$$
$$C_2 = C_0 - \Delta C_1$$
$$\vdots$$
$$C_{m-2} = C_{m-3} + \Delta C_{m-2}$$
$$C_{m-1} = C_{m-2} - \Delta C_{m-1}.$$

25. A noise codebook as set forth in claim 23, wherein said stages include high and low stages, and wherein a first group of said initial and delta vectors having first intercode distances are stored in said high stages, and a second group of said initial and delta vectors having second intercode distances are stored in said low stages, and said first intercode distances being greater than said second intercode distances.

26. A method of storing noise trains as code vectors in a noise codebook included in a speech coding system, comprising the steps of:

(a) storing an initial vector in a delta vector codebook included in the noise codebook; and (b) storing delta vectors determined from differences between the code vectors in the delta vector codebook, where the initial and delta vectors are used to reproduce the code vectors.

27. A method of storing noise trains as code vectors in a noise codebook included in a speech coding system, comprising the steps of:

(a) storing an initial vector in a delta vector codebook included in the noise codebook;

(b) storing delta vectors determined from differences between the code vectors in the delta vector codebook, where the initial and delta vectors are used to reproduce the code vectors; and (c) generating the code vectors $C_i$, i being a first integer between 0 and (m−1), and m being a second integer representing a number of the noise trains stored in the noise codebook, according to:

$$C_0 = C_0$$
$$C_1 = C_0 + \Delta C_1$$
$$C_2 = C_1 + \Delta C_2$$
$$\vdots$$
$$C_{m-1} = C_{m-2} + \Delta C_{m-1}.$$

28. A method of storing noise trains as code vectors in a noise codebook included in a speech coding system, comprising the steps of:

(a) storing an initial vector in a delta vector codebook included in the noise codebook;

(b) storing delta vectors determined from differences between the code vectors in the delta vector codebook, where the initial and delta vectors are used to reproduce the code vectors; and (c) generating the code vectors by computing and cyclically adding the delta vectors.

29. A method of storing noise trains as code vectors in a noise codebook included in a speech coding system, comprising the steps of:

(a) storing an initial vector in a delta vector codebook included in the noise codebook;

(b) storing delta vectors determined from differences between the code vectors in the delta vector codebook, where the initial and delta vectors are used to reproduce the code vectors;

(c) computing powers of the initial and delta vectors; and (d) re-storing the initial and delta vectors in the delta vector codebook based on the powers computed in said computing step (c).

30. A method of storing noise trains as code vectors in a noise codebook included in a speech coding system, comprising the steps of:

(a) storing an initial vector in a delta vector codebook included in the noise codebook; and (b) storing delta vectors determined from differences between the code vectors in the delta vector codebook, where the initial and delta vectors are used to reproduce the code vectors, wherein said storing step (a) and said storing step (b) store the initial vector and (L−1) types of the delta vectors based on a tree-structure having stages, where L is a first number of the stages in the tree-structure.

31. A method as set forth in claim 30, further comprising, after said storing step (b), the step of generating the code vectors $C_i$, i being a first integer between 0 and (m−1), and m being a second integer representing a second number of the noise trains stored in the noise codebook, according to:

$$C_0 = C_0$$
$$C_1 = C_0 + \Delta C_1$$
$$C_2 = C_0 - \Delta C_1$$
$$\vdots$$
$$C_{m-2} = C_{m-3} + \Delta C_{m-2}$$
$$C_{m-1} = C_{m-2} - \Delta C_{m-1}.$$

32. A method as set forth in claim 30, wherein said stages include high and low stages, and wherein said method further comprises, after said storing step (b), the step of re-storing in the delta vector codebook a first group of the initial and delta vectors having first intercode distances in the high stages, and a second group of the initial and delta vectors having second intercode distances in the low stages, and the first intercode distances being greater than the second intercode distances.

* * * * *

UNITED STATES PATENT AND TRADEMARK OFFICE

CERTIFICATE OF CORRECTION

PATENT NO. : 5,323,486

DATED : June 21, 1994

INVENTOR(S) : Tomohiko TANIGUCHI et al.

It is certified that error appears in the above-indentified patent and that said Letters Patent is hereby corrected as shown below:

Column 4, Line 30, change " $|E|^2=AX-gAC^2$ " to -- $|E|^2=|AX-gAC|^2$ --.

Column 5, Line 23, after "(AC)" insert --)--.

Column 9, Line 65, "(AH)3'" should be --(AH) 3'--.

Column 11, Line 6, after "are" (first occurrence) insert --stored in the delta vector codebook 11, the delta--.

Line 64, after "AX" delete "-".

Line 67, after "(AC)" delete "-".

Column 14, Line 12, change " $C_{2K+1}C_K+\Delta C_i$ " to -- $C_{2K+1}=C_K+\Delta C_i$ --.

Line 13, change " $C_{2K+2}C_K-\Delta C_i$ " to -- $C_{2K+2}=C_K-\Delta C_i$ --.

Line 16, change "ΔC" to --$\Delta C_1$--.

Column 17, Line 3, after "(AΔ" delete "-".

Column 22, Line 61, after "bAP+" delete "-".

Column 23, Line 39, after "(AC)" delete "-".

Line 57, change " $b=[(AC)^TAC(AP)^TAX-(AP)^TAP(AP)^TAX]/\nabla$ "

to -- $b=[(AC)^TAC(AP)^TAX-(AC)^TAP(AC)^TAX]/\nabla$ --.

UNITED STATES PATENT AND TRADEMARK OFFICE

CERTIFICATE OF CORRECTION

PATENT NO. : 5,323,486

DATED : June 21, 1994

INVENTOR(S) : Tomohiko TANIGUCHI et al.

It is certified that error appears in the above-indentified patent and that said Letters Patent is hereby corrected as shown below:

Column 24, Line 16, after "(AC)" delete "-".
Line 36, after "AX" delete "-".
Line 38, change "AX'" to --AX,--.

Column 25, Line 68, change "un" to --unit vector--.

Column 26, Line 35, change "data" to --dots--.

Column 27, Line 2, after "(AHC$_i$)" delete "-".

Signed and Sealed this

Sixth Day of September, 1994

*Attest:*

*Attesting Officer*

BRUCE LEHMAN

*Commissioner of Patents and Trademarks*